US008253098B2

(12) United States Patent
Hiraoka et al.

(10) Patent No.: US 8,253,098 B2
(45) Date of Patent: Aug. 28, 2012

(54) IONIZATION ANALYSIS METHOD AND APPARATUS

(75) Inventors: Kenzo Hiraoka, Kofu (JP); Lee Chuin Chen, Kofu (JP)

(73) Assignee: University of Yamanashi, Kofu-shi (JP)

( * ) Notice: Subject to any disclaimer, the term of this patent is extended or adjusted under 35 U.S.C. 154(b) by 64 days.

(21) Appl. No.: 13/001,330

(22) PCT Filed: Jun. 4, 2009

(86) PCT No.: PCT/JP2009/060653

§ 371 (c)(1),
(2), (4) Date: Dec. 23, 2010

(87) PCT Pub. No.: WO2009/157312

PCT Pub. Date: Dec. 30, 2009

(65) Prior Publication Data

US 2011/0108726 A1 May 12, 2011

(30) Foreign Application Priority Data

Jun. 27, 2008 (JP) ..... 2008-169679

(51) Int. Cl.
*H01J 49/10* (2006.01)

(52) U.S. Cl. ..... 250/288; 250/423 R

(58) Field of Classification Search ..... 250/288, 250/281, 282, 423 R, 424
See application file for complete search history.

(56) References Cited

U.S. PATENT DOCUMENTS 5,349,186 A * 9/1994 Ikonomou et al. ..... 250/288
5,669,904 A 9/1997 Platt, Jr. et al.
6,107,626 A 8/2000 Wang et al.
6,114,693 A * 9/2000 Hirabayashi et al. ..... 250/288
6,147,347 A * 11/2000 Hirabayashi et al. ..... 250/288
2004/0089802 A1 5/2004 Kato
2005/0211685 A1 9/2005 Blankenship

FOREIGN PATENT DOCUMENTS

CN 101281165 A 10/2008
JP 61-54723 B2 11/1986
JP 8-28197 B2 3/1996
JP 10-503410 A 3/1998
JP 2004-146219 A 5/2004

(Continued)

OTHER PUBLICATIONS

International Search Report, PCT/JP2009/060653, Sep. 1, 2009.

(Continued)

*Primary Examiner* — Kiet T Nguyen

(74) *Attorney, Agent, or Firm* — Birch, Stewart, Kolasch & Birch, LLP

(57) ABSTRACT

An ionization apparatus comprises a first electrode provided on the outer periphery of a dielectric cylindrical body and a second cylindrical electrode placed inside at a center of the cylindrical body. When an AC high voltage is impressed across the first electrode and the second cylindrical electrode, a barrier discharge occurs within the cylindrical body. A distal end portion of the second cylindrical electrode projects outwardly from the distal end of the cylindrical body, a thermal equilibrium plasma P having a low electron temperature is generated outwardly from the distal end of the cylindrical body without a plasma jet ascribable to the barrier discharge emerging outwardly from the distal end of the cylindrical body. By exposing a sample S to the thermal equilibrium plasma P, particles (atoms, molecules) desorbed from the sample S undergo soft ionization without being decomposed or polymerized.

19 Claims, 30 Drawing Sheets

FOREIGN PATENT DOCUMENTS

| | | | |
|---|---|---|---|
| JP | 2006-196291 | A | 7/2006 |
| WO | WO 2008/153199 | A | 12/2008 |

OTHER PUBLICATIONS

Na Na et al., "Developement of a Dielectric Barrier Discharge Ion Source for Ambient Mass Spectrometry", Journal American Society for Mass Spectrometry, vol. 18, Issue 10, 2007, pp. 1859-1862.

Na Na et al., "Direct detection of explosives on solid surfaces by mass spectrometry with an ambient ion source based on dielectric barrier discharge", Journal of Mass Spectrometry, vol. 42, 2007, pp. 1079-1085.

Wriiten Opinion PCT/IPEA/408, PCT/JP2009/060653, Feb. 23, 2010.

Written Opinion PCT/ISA/237, PCT/JP2009/060653, Sep. 1, 2009.

* cited by examiner

IONIZATION ANALYSIS METHOD AND APPARATUS

TECHNICAL FIELD

This invention relates to an atmospheric-pressure ionization analysis method and apparatus utilizing barrier discharge.

BACKGROUND ART

Examples of an ionization analysis method and apparatus utilizing barrier discharge are described in the following literature:

1. Na Na, Chao Zhang, Mengxia Zhao, Sichun Zhang, Chengdui Yang, Xiang Fang and Xinrong Zhang, "Direct detection of explosives on solid surfaces by mass spectrometry with an ambient ion source based on dielectric barrier discharge", J. Mass Spectrom. 2007; 42:1079-1085

2. Na Na, Mengxia Zhao, Sichun Zhang, Chengdui Yang and Xinrong Zhang, "Development of a Dielectric Barrier Discharge Ion Source for Ambient Mass Spectrometry", J Am Soc Mass Spectrom. 2007, 18, 1859-1862

The ion analysis method and apparatus described in these references have a plate-shaped electrode, a glass plate placed on the surface of the plate-shaped electrode and a needle-shaped electrode disposed substantially perpendicular to the surface of the glass plate (the plate-shaped electrode) and spaced away from the glass plate, and impress an alternating high-voltage across the plate-shaped electrode and needle-shaped electrode and induce a barrier discharge. A sample serving as an object to undergo analysis is placed on the glass plate and is exposed to a plasma torch produced by the barrier discharge. As a result, atoms and molecules are desorbed from the sample and ionized. The ions are introduced to a mass analyzer and analyzed.

Since a sample is exposed directly to a plasma torch (non-equilibrium plasma) produced by barrier discharge in the ion analysis method and apparatus described in the references cited above, decomposition of the sample itself by high-energy electrons in the plasma, decomposition of molecules desorbed from the sample and ionized, and polymerization of fragment ions produced by decomposition and the like occur. A problem, therefore, is that there are cases where accurate analysis cannot always be achieved.

DISCLOSURE OF THE INVENTION

The present invention provides an ionization method and apparatus, as well as an ionization analysis method and apparatus, in which it is difficult for sample decomposition and decomposition or polymerization of ions to occur, thereby making accurate analysis possible.

An object of the present invention is to improve the sensitivity of analysis.

A further object of the present invention is to so arrange it that positive ions or negative ions can be produced selectively.

Yet another object of the present invention is to promote the desorption of sample particles such as molecules or atoms from a sample in ionization.

An ionization apparatus according to the present invention includes a cylindrical body comprising a dielectric; a first electrode provided on the outer side of the cylindrical body in the vicinity of a distal end portion thereof; and a second electrode disposed inside the cylindrical body in the vicinity of the center thereof defining a clearance between itself and an inner surface of the cylindrical body, extending along the longitudinal direction of the cylindrical body and projecting outwardly from the distal end portion of the cylindrical body passing the position at which the first electrode is provided.

By impressing an alternating voltage across the first and second electrodes, the cylindrical body comprising a dielectric (an insulator) becomes a barrier and a barrier discharge is induced inside the cylindrical body. The cylindrical body also acts to confine the plasma (non-equilibrium plasma) produced by the barrier discharge.

Since the second electrode disposed inside the cylindrical body projects outwardly from the distal end of the cylindrical body, a thermal equilibrium plasma is produced outwardly of the distal end of the cylindrical body. Since the electron temperature of the thermal equilibrium plasma is low, decomposition of the sample or ions does not occur and fragment ions are not polymerized. By exposing the sample to the thermal equilibrium plasma (a charged gas current) produced outwardly of the distal end of the cylindrical body, particles (atoms and molecule), etc., desorbed from the sample are ionized. As a result, accurate and highly sensitive ionization analysis is possible.

It does not matter if the cross section of the cylindrical body is rectangular (inclusive of square), polygonal (an n-sided polygon, where n is equal to or greater then 3), elliptical, circular or any other shape.

Since a barrier discharge need only be induced within the cylindrical body by applying an alternating voltage across the first and second electrodes, the first electrode need not necessarily extend over the entire periphery of the outer surface of the cylindrical body and may be provided at one location or dispersed at two or more locations at a portion of the entire periphery. Likewise, the cylindrical body need not be closed over its entire periphery and may have a cut-out at a portion thereof so that its interior and exterior are in communication. The first electrode may be flat or curved, as a matter of course. The outer surface of the cylindrical body may be formed to have a groove or recess, and the first electrode may be provided in this groove or recess. That is, it will suffice if at least a portion of the cylindrical body is present between the first and second electrodes.

The second electrode can take on a variety of shapes. Typically, the second electrode is needle-shaped or slender-tube-shaped (a capillary). With regard to a slender-tube-shaped second electrode, a slender tube per se may be formed from metal to obtain the second electrode, or a metal film may be formed on, or a metal cylinder fitted over, the surface of the cylindrical body of an insulator and the resulting body may be adopted as the second electrode. In a case where the second electrode is slender-tube-shaped, the second electrode is endowed with a function in addition to that of an electrode. For example, as will be described later, the second electrode (slender tube) can be used as a tube that supplies an electrospray solvent and can also be used as a tube that supplies a gaseous sample (an object to be ionized). In case of a suction type described later, the second electrode (slender tube) is connected to a mass analyzer and can also be used as a conduit (ion introduction pipe) for introducing generated ions to the mass analyzer.

A DC voltage is impressed across the first and second electrodes and a positive-ion-rich or negative-ion-rich charged gas current is produced in accordance with the polarity of this DC voltage. This makes possible selective positive ionization or negative ionization of particles (atoms and molecules) desorbed from the sample.

By applying a voltage higher positive or negative than the DC voltage to a conductor placed in back of the sample, the positive or negative ions generated can be introduced to the mass analyzer more efficiently in case of the above-mentioned suction-type arrangement.

By disposing a mesh electrode in close proximity to the dital end of the second electrode outwardly of this end and applying a positive or negative DC voltage to this mesh electrode, ions that are generated by the barrier discharge plasma and that represent noise are excluded so that the desired ions can be extracted (introduced to the analyzer). As a result, more accurate, highly sensitive ion analysis is possible.

It may be so arranged that a discharge gas or carrier gas is supplied actively to the cylindrical body (or more exactly, to the gap between the cylindrical body and the second electrode), and atmospheric air may be adopted as the discharge gas depending upon the case.

There are various methods of promoting the desorption of the sample. For example, methods include spraying the sample with fine droplets of a solvent by droplet spraying means (droplet injection by electrospray or microjet, etc., or simply atomizing the solvent solution by a nebulizer gas); heating the sample; subjecting the sample to ultrasonic vibration; irradiating the sample with laser light; and forming a photon field in the vicinity of the sample surface, etc. Further, the desorption of the sample can also be promoted by heating the discharge gas.

Ionization analysis is carried out by introducing sample ions, which have been produced by the above-described ionization method, to an analyzer.

The present invention is directly applicable to all kinds of samples. From the standpoint of the state of existence of the sample (substance), the present invention is effective in ionizing (and, hence, in analyzing) all liquid samples, solid samples and gaseous (including vaporous) samples. From the standpoint of type of sample (substance), the present invention is applicable to all types, such as biological samples (raw biological samples, biological tissue, cells, bacteria, blood, urine and perspiration, etc.), inorganic materials in general (metals, semiconductors, other inorganic matter and inorganic compounds) and organic materials in general (fibers, polymers), etc. It is possible to desorb and ionize volatile components among these samples as a matter of course, as well as refractory components and nonpolar compounds. From the standpoint of application and usage, etc., the invention is effective in criminal investigations (detection of drugs in blood or urine, etc.) by reason of the fact that detection of drugs is possible, and in combating terrorism (detection of biological weapons) since application to biological samples is possible. Since detection of plasticizer in macromolecules and environmental hormone preparations and detection of contaminants on high-resolution printed boards also is possible, the present invention is applicable to materials analysis, environmental protection and process management, etc. Thus, the present invention, in addition to affording an all-round ionization method, possesses ultra-high sensitivity and is therefore applicable to nano-imaging (because it provides sufficient ion intensity even when the amount of sample desorbed is extremely small).

BEST MODE FOR CARRYING OUT THE INVENTION

First Embodiment

Figure 1:
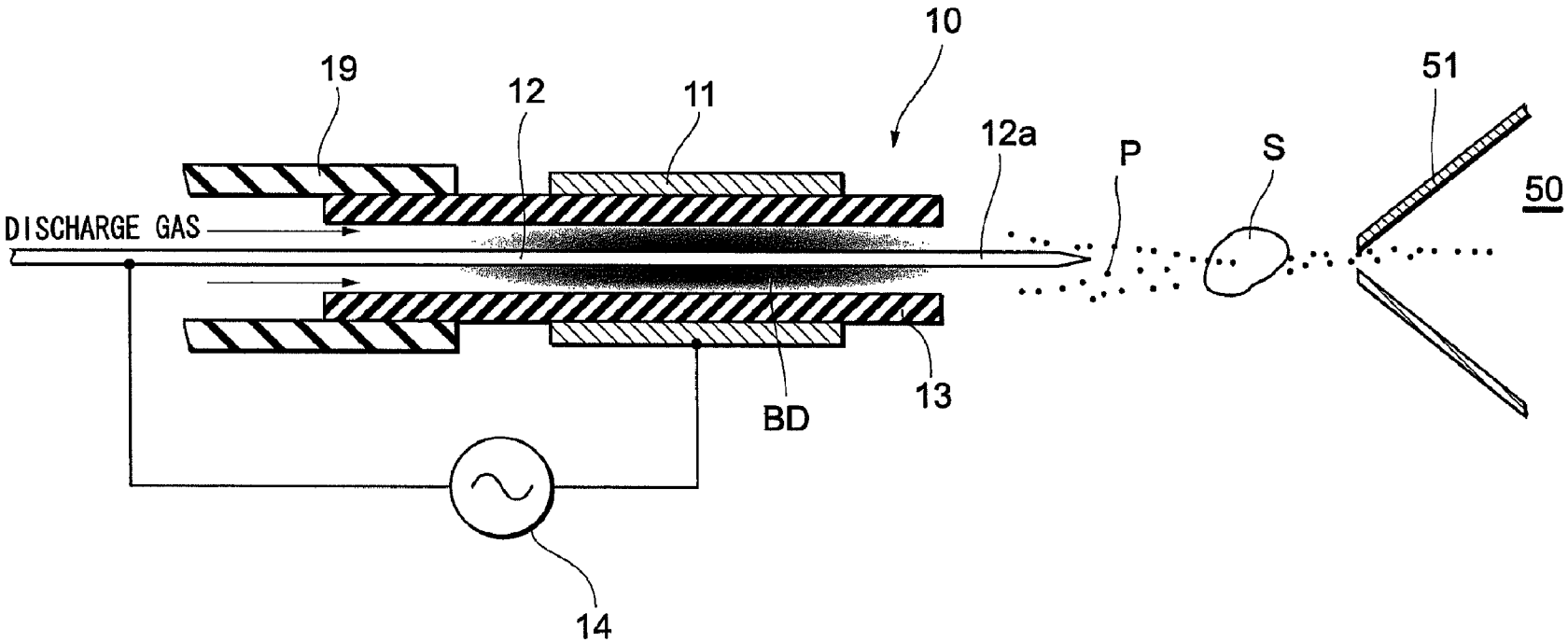
FIG. 1 illustrates the principle of ionization according to the present invention and shows an arrangement of an ionization apparatus and ionization analysis apparatus according to a first embodiment of the present invention.

FIG. 1 illustrates the principle of ionization according to the present invention and shows an arrangement of an ionization apparatus and ionization analysis apparatus according to a first embodiment of the present invention.

Sample ions that have been ionized by the ionization method and apparatus according to the present invention (ions of particles such as atoms and molecules desorbed from a sample) are introduced to and analyzed by a mass analyzer. The apparatus (method) of the embodiments is mainly classified broadly into that of a spray type (or blow type) and that of a suction type depending upon a difference in the principle according to which the sample ions are introduced to the mass analyzer. The principle of ionization is the same in both types. The first embodiment relates to the spray-type arrangement.

In FIG. 1, an ionization apparatus 10 includes a cylindrical body 13 comprising a dielectric (or insulator) (e.g., a ceramic or glass, etc.); an annular (or cylindrical) first electrode 11 provided in close proximity to the outer peripheral surface at a location somewhat near the distal end (the right end in FIG. 1) of the cylindrical body 13; and a second electrode, namely a needle-shaped electrode 12, disposed on the central axis internally of the cylindrical body 13 in spaced-apart relation to the inner peripheral surface of the cylindrical body 13 and supported by a support member (not shown). A gas supply tube 19 is connected to the base end of the cylindrical body 13 and a discharge gas (which acts as a carrier gas as well) is supplied by a discharge-gas supply device (a discharge-gas tank or the like) (not shown) so as to flow through the interior of the cylindrical body 13 in the direction from the base end to the distal end. By way of example, the discharge gas is a rare gas such as helium (He), nitrogen ($N_2$) or air (atmospheric air) (the same holds true also in the other embodiments described later).

The distal end (indicated at reference symbols 12*a*) of the needle-shaped electrode 12 projects outwardly from the distal end of the cylindrical body 13.

An AC high voltage (e.g., a voltage of several hundred volts to tens of kilovolts and a frequency of several kilohertz to tens of kilohertz) is impressed across the first electrode 11 and second electrode 12 by an AC high-voltage power supply 14. Since the dielectric (insulator) (cylindrical body 13) exists between the electrodes 11 and 12, a barrier discharge occurs across the electrodes 11 and 12. Since the electrode 11 is in close proximity to the peripheral surface of the cylindrical body 13 and there is a gap between the electrode 12 and the inner peripheral surface of the cylindrical body 13, a non-equilibrium plasma ascribable to barrier discharge BD is produced in this gap (inside the cylindrical body 13). With a non-equilibrium plasma, the electron temperature is a high tens of thousands of degrees, and since the these high-energy electrons excite the atoms and molecules in the discharge gas, they emit light (they can be seen sparkling) (the light emission is indicated in gray in FIG. 1).

Since the distal end 12*a* of the second electrode 12 projects outwardly beyond the distal end of the cylindrical body 13, the high-energy electrons caused to flow by the discharge-gas current are extinguished owing to the existence of the second electrode 12 (distal end 12*a*), the energy of the electrons (the electron temperature) falls (on the order of 100° C.) and becomes a thermal equilibrium plasma P. [Since the thermal equilibrium plasma P does not produce light, it is not visible to the eye. The thermal equilibrium plasma P is illustrated by the small black dots. Further, the ions of particles (molecules or atoms) of the sample S ionized by the thermal-equilibrium plasma are also indicated by small black dots in the diagram.]

Figure 2:
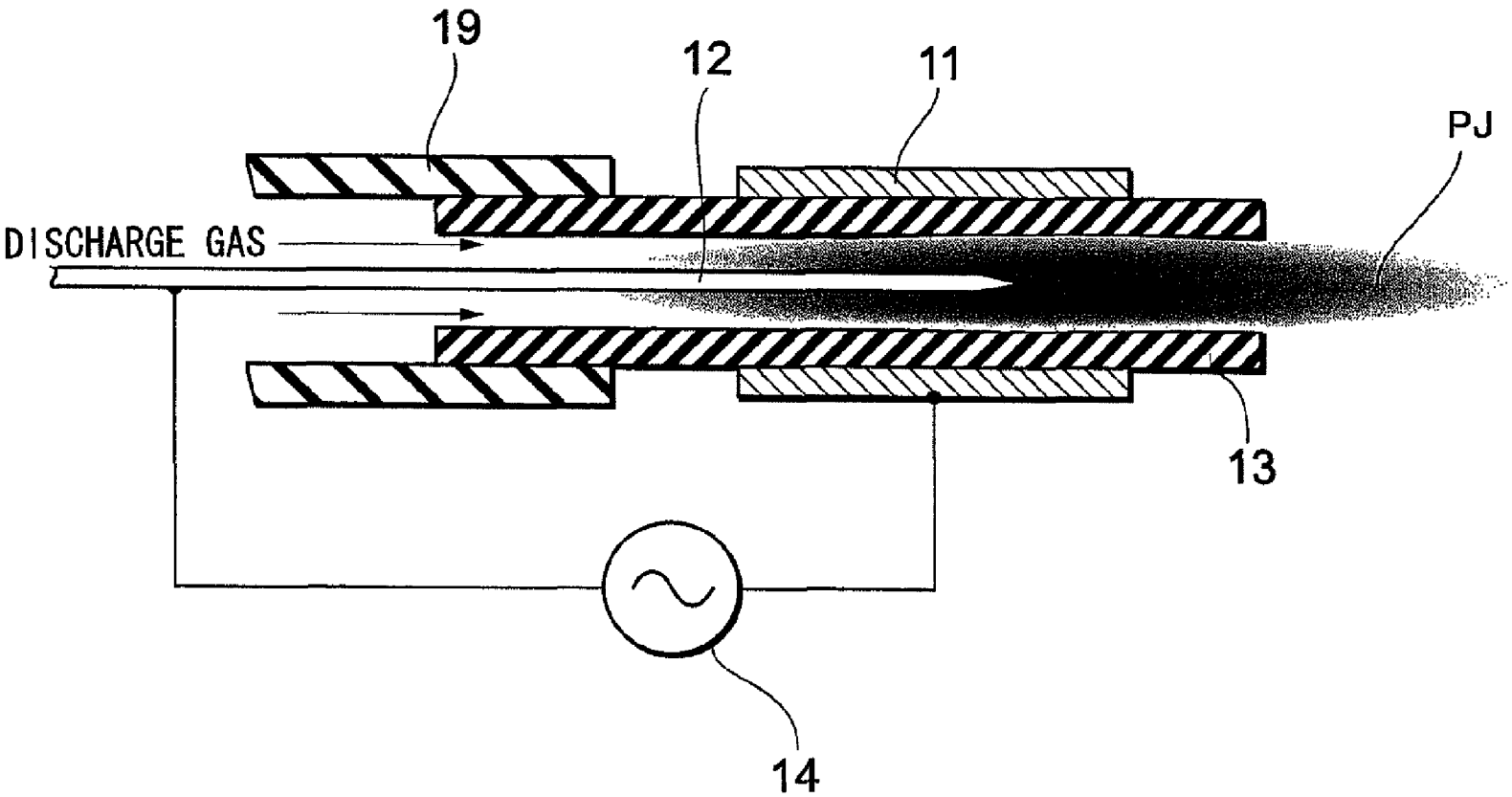
FIG. 2 illustrates, for the sake of comparison, an arrangement in which a needle-shaped electrode has been withdrawn into a cylindrical body for the purpose of clarifying the principle of soft ionization according to the present invention.

Reference will be had to FIG. 2 in order to clarify by comparison the features of the ionization apparatus shown in FIG. 1. Components in FIG. 2 identical (with the exception of placement) with those shown in FIG. 1 are designated by like reference symbols. The difference between the arrangement shown in FIG. 1 and that shown in FIG. 2 is that whereas the distal end 12*a* of the second electrode (needle-shaped electrode) 12 extends outwardly from the distal end of the cylindrical body 13 in the arrangement of FIG. 1, the distal end of the second electrode (needle-shaped electrode) 12 has been withdrawn into the cylindrical body 13 in the arrangement shown in FIG. 2. When an AC high-voltage is impressed across the two electrodes 11 and 12 in the arrangement shown in FIG. 2, a barrier discharge occurs inside the cylindrical body 13 and a plasma jet PJ that arises owing to the barrier discharge extends outwardly from the distal end of the cylindrical body 13. The plasma jet PJ contains high-energy electrons and emits light. When a sample is exposed to the plasma jet PJ, decomposition of the sample itself by high-energy electrons in the plasma jet PJ, decomposition of molecules desorbed from the sample and ionized, and polymerization of fragment ions produced by decomposition occur. This is a result identical with that seen in the above-described prior art (References 1 and 2).

In accordance with this embodiment (the present invention), the distal end 12*a* of the second electrode (needle-shaped electrode) 12 extends outwardly from the distal end of the cylindrical body 13, as shown in FIG. 1. The thermal equilibrium plasma P, therefore, is produced outwardly of the distal end of the cylindrical body 13. If the sample is exposed to the thermal equilibrium plasma P, ionization of the sample takes place (this is referred to as "soft ionization") with almost no occurrence of decomposition of the sample and molecules and polymerization of fragment ions that are seen in the prior art.

Metastable excited species produced from the discharge gas, heated electrons (thermoelectrons) and ion species, etc., exist in the thermal equilibrium plasma P. When the sample S is placed in this thermal equilibrium plasma P, the sample particles (atoms, molecules, etc.) desorbed from the sample S as by vaporization are ionized (Penning ionization, reactive ionization) by the metastable excited species and ion species, etc. In molecules having positive electron affinity, thermal electrons attach themselves to the molecules and negative ions are produced efficiently. Sample ions thus ionized are introduced by the flow of discharge gas into the interior of a mass analyzer 50 through an ion sampling orifice (or skimmer) 51 of the mass analyzer 50, which is placed downstream. Mass spectrometers of all types that introduce ions into a vacuum from atmospheric pressure can be used as the mass analyzer 50, examples being a time-of-flight mass spectrometer, an ion-trap mass spectrometer and a quadrupole mass spectrometer, etc.

Figure 3:
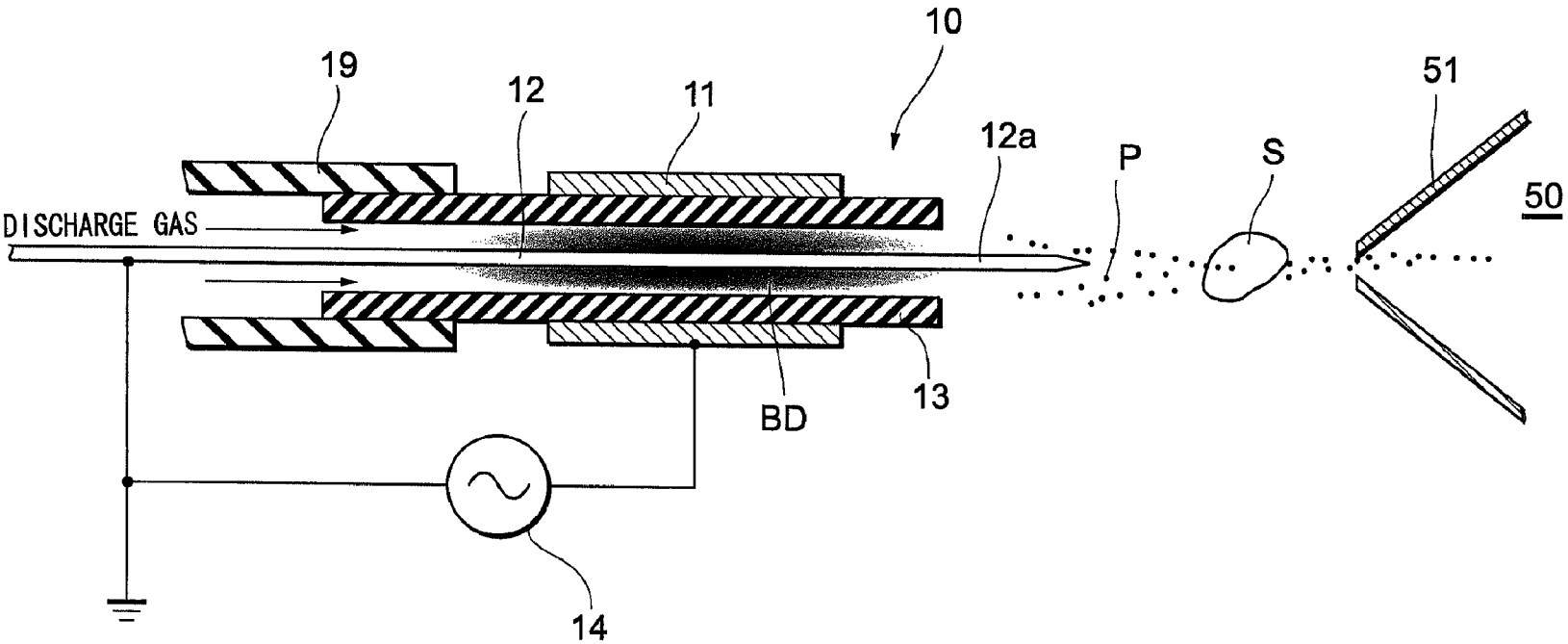
FIG. 3 illustrates a modification of the ionization apparatus and ionization analysis apparatus according to the first embodiment.

FIG. 3 illustrates a modification. Here the second electrode 12 is grounded. With this arrangement, the introduction of positive ions into the mass analyzer 50 is facilitated if the potential of an orifice 51 of the mass analyzer 50 is made lower than ground potential (i.e., is made negative). Conversely, introduction of negative ions is facilitated if the potential of orifice 51 is made positive.

Figure 4:
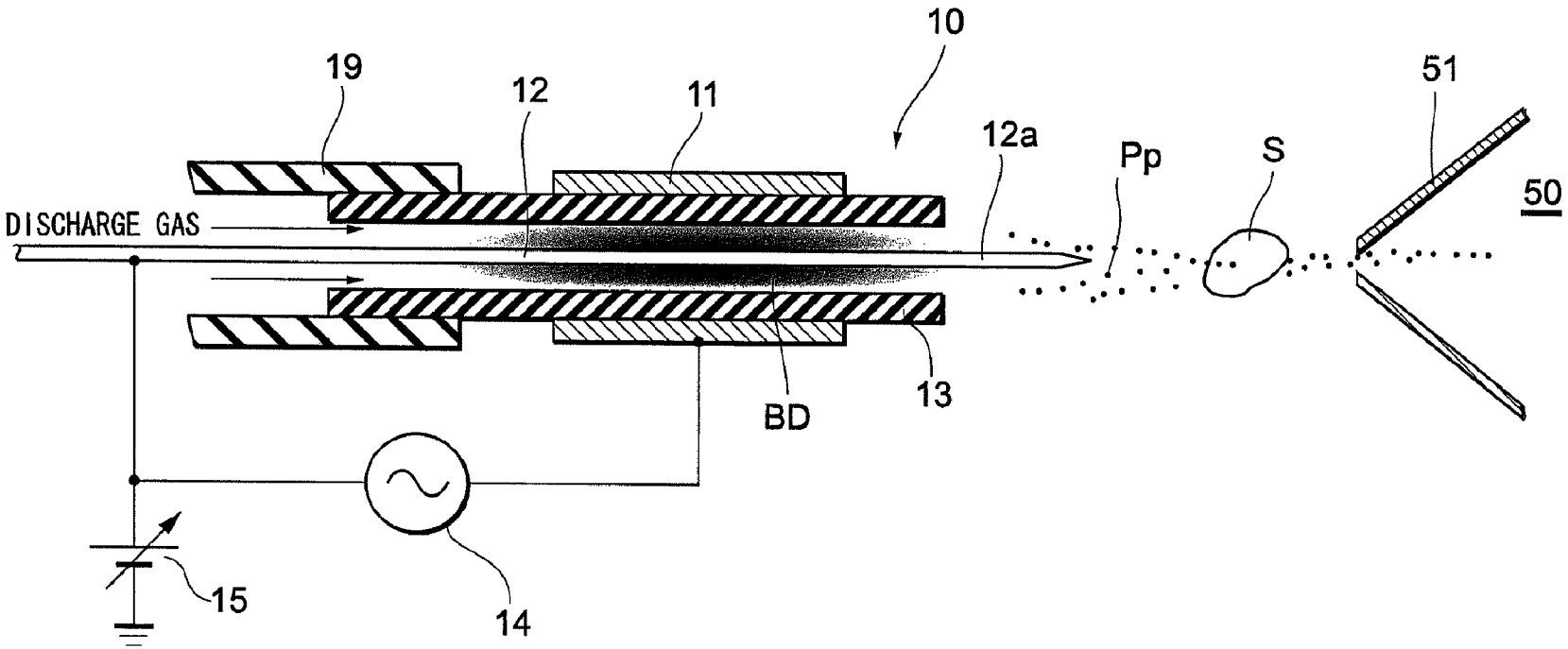
FIG. 4 illustrates another modification of the ionization apparatus and ionization analysis apparatus according to the first embodiment.

FIG. 4 illustrates another modification. A potential (e.g., 100V to several hundred volts) positive with respect to ground potential is applied to the second electrode 12 by a DC power supply 15. The DC power supply 15 preferably is one the voltage of which is variable.

With the arrangement shown in FIG. 4, since a potential positive with respect to ground potential is applied to the second electrode (needle-shaped electrode) 12 inside the cylindrical body 13, electrons and negative ions in the thermal equilibrium plasma are captured by the second electrode 12 and a charged gas current containing more positive ions (more positive ions than electrons or negative ions) is produced (this is referred to as a "positive-ion-rich charged gas current Pp").

When the sample S is placed in the positive-ion-rich charged gas current Pp, most of the particles desorbed from the sample S are positively ionized. Accordingly, positive ions rather than negative ions are introduced into the mass analyzer 50. The ionization apparatus (ionization analysis apparatus) shown in FIG. 4 is particularly suited to analysis of a sample that is easily positively ionized (this is a positive-ion measurement mode). In this mode positive ions are introduced into the mass analyzer 50 more readily if the second electrode 12 is placed at the high potential rather than the orifice 51.

Figure 5:
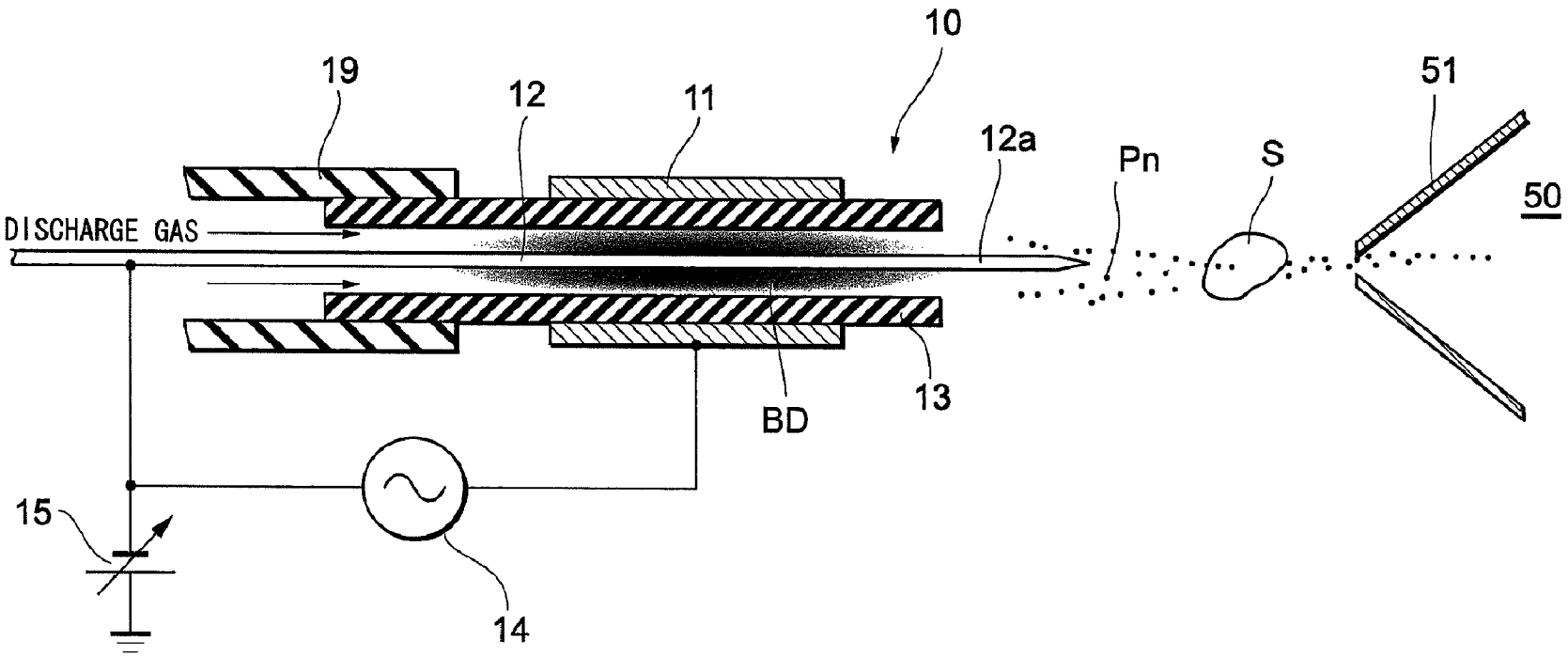
FIG. 5 illustrates a further modification of the ionization apparatus and ionization analysis apparatus according to the first embodiment.

FIG. 5 illustrates a further modification. With this arrangement, a DC voltage is applied by the DC power supply 15 in such a manner that the second electrode 12 will be negative with respect to ground potential.

With this arrangement, since a potential that is negative with respect to ground potential is applied to the second electrode (needle-shaped electrode) 12 inside the cylindrical body 13, positive ions in the thermal equilibrium plasma are captured by the second electrode 12 and a charged gas current containing more electrons or negative ions (more electrons or negative ions than positive ions) is produced (this is referred to as a "negative-ion-rich charged gas current Pn"). In this mode negative ions are introduced to the mass analyzer 50 more readily if the second electrode 12 is placed at the low potential (large on the negative side) rather than the orifice 51.

When the sample S is placed in the negative-ion-rich charged gas current Pn, most of the particles desorbed from the sample S are negatively ionized. Accordingly, negative ions rather than positive ions are introduced into the mass analyzer 50. The ionization apparatus (ionization analysis apparatus) shown in FIG. 5 is particularly suited to analysis of a sample that is easily negatively ionized (this is a negative-ion measurement mode).

Figure 6A:
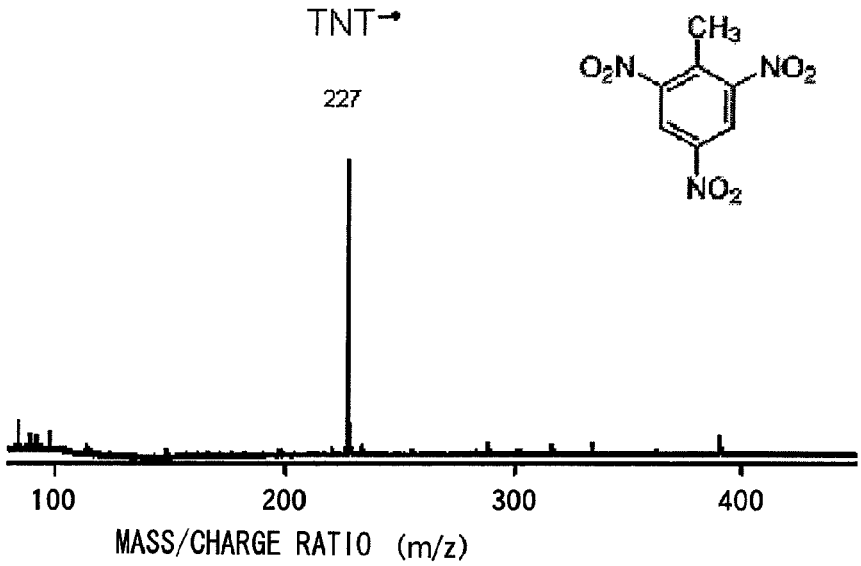
FIG. 6A, which illustrates result of analysis of trinitrotoluene (TNT) as one example of an explosive, is a graph obtained by using the ionization analysis apparatus of the first embodiment of the present invention.
Figure 6B:
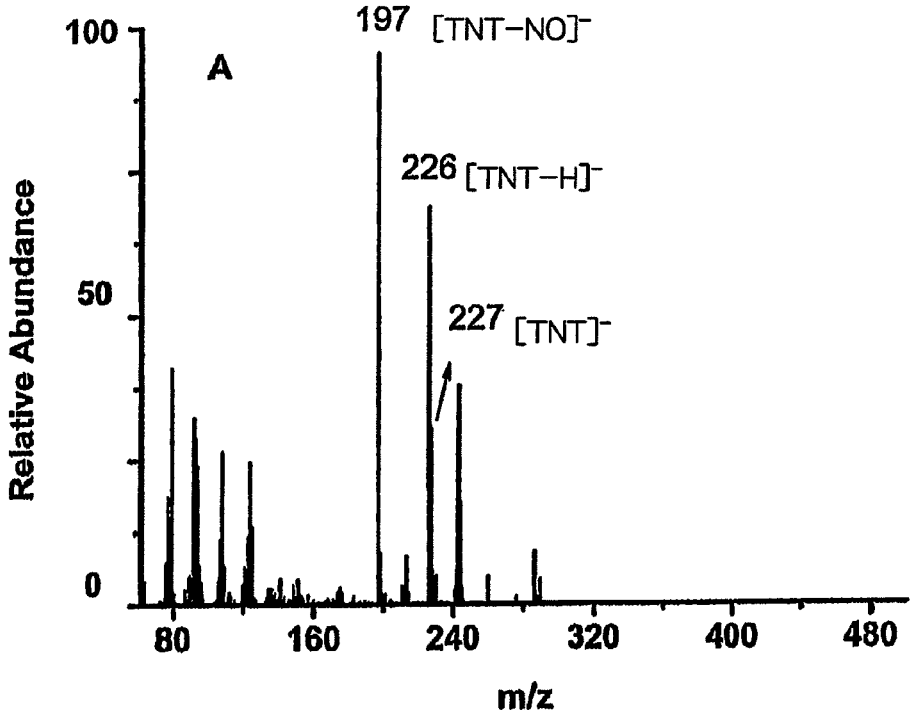
FIG. 6B is a graph indicating result of analysis of trinitrotoluene (TNT) described in Reference 1.

FIGS. 6A and 6B illustrate results of analysis of trinitrotoluene (TNT) as one example of an explosive. FIG. 6A illustrates analytical results obtained by dripping 10 μL of a 3-ppm TNT acetonitrile solution onto a swab, placing the swab in the thermal equilibrium plasma P (negative-ion-rich charged gas current Pn) jetted from the cylindrical body 13 and analyzing the vapor using the arrangement of FIG. 5 as the ionization analysis apparatus. It can be understood that only radical anions of TNT are detected with high sensitivity. FIG. 6B illustrates analytical results, depicted as FIG. 3 in Reference 1, for the sake of comparison. Many fragment ions appear owing to exposure of the sample to a plasma torch.

Figure 7A:
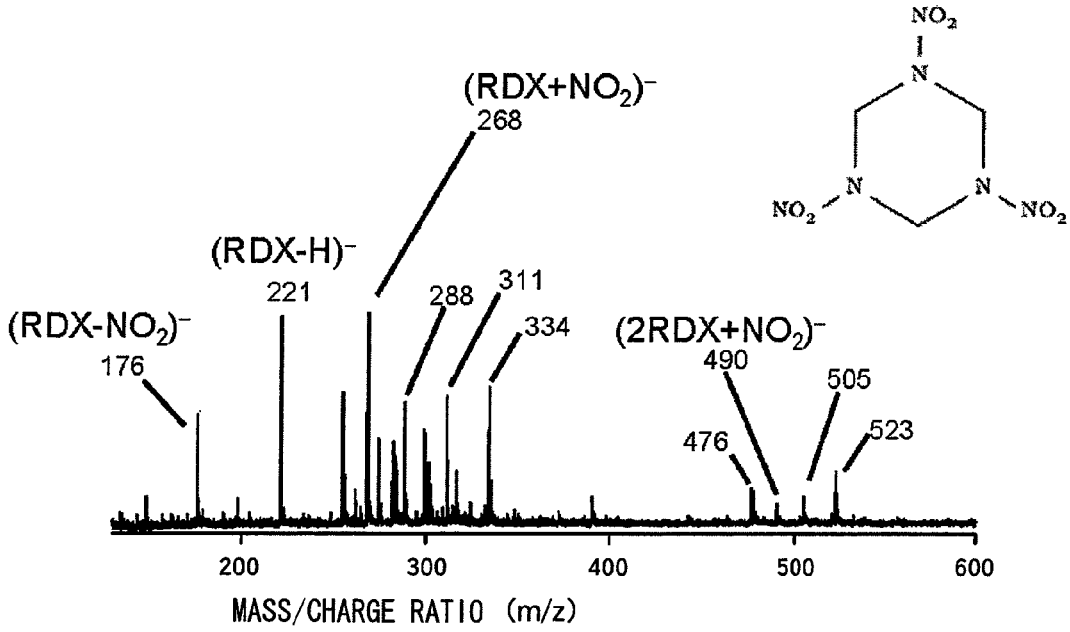
FIG. 7A, which illustrates result of analysis of another example of an explosive using the apparatus of the first embodiment of the present invention, is a graph indicating result of analyzing RDX.
Figure 7B:
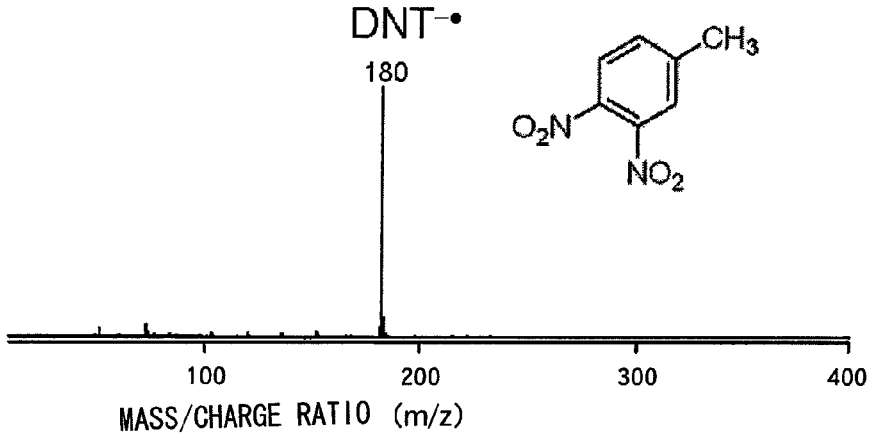
FIG. 7B is a graph indicating result of analysis of another explosive DNT using the same apparatus.

FIGS. 7A and 7B also illustrate analytical results regarding an explosive obtained using the ionization analysis apparatus shown in FIG. 5. FIG. 7A is a graph indicating the result of analyzing R.D.X. (trimethylenetrinitroamine) (3-ppm RDX acetonitrile solution). FIG. 7B is a graph indicating the result of analyzing dinitrotoluene (DNT) (12-ppm DNT acetonitrile solution). The analytical method is the same as that in the case of TNT. It will thus be understood that in accordance with the ionization analysis apparatus of the first embodiment, various explosives can be detected with high sensitivity.

Figure 8:
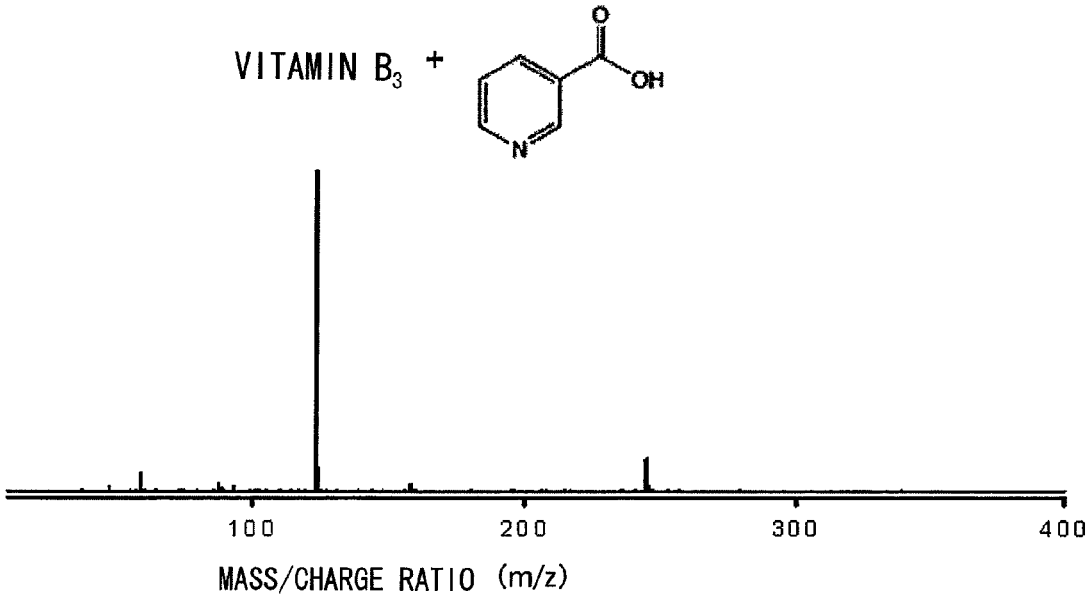
FIG. 8 is a graph obtained by analyzing a vitamin $B_3$ tablet as an example of a medicine tablet sample using the apparatus of the first embodiment.

FIG. 8 illustrates the result of analyzing a vitamin $B_3$ tablet as an example of a medicine tablet sample. This is a graph obtained by disposing a vitamin $B_3$ tablet in the thermal equilibrium plasma P (positive-ion-rich charged gas current Pp) jetted from the cylindrical body 13 shown in FIG. 4. It can be understood that positive ions of vitamin $B_3$ are detected with high sensitivity.

Figure 9:
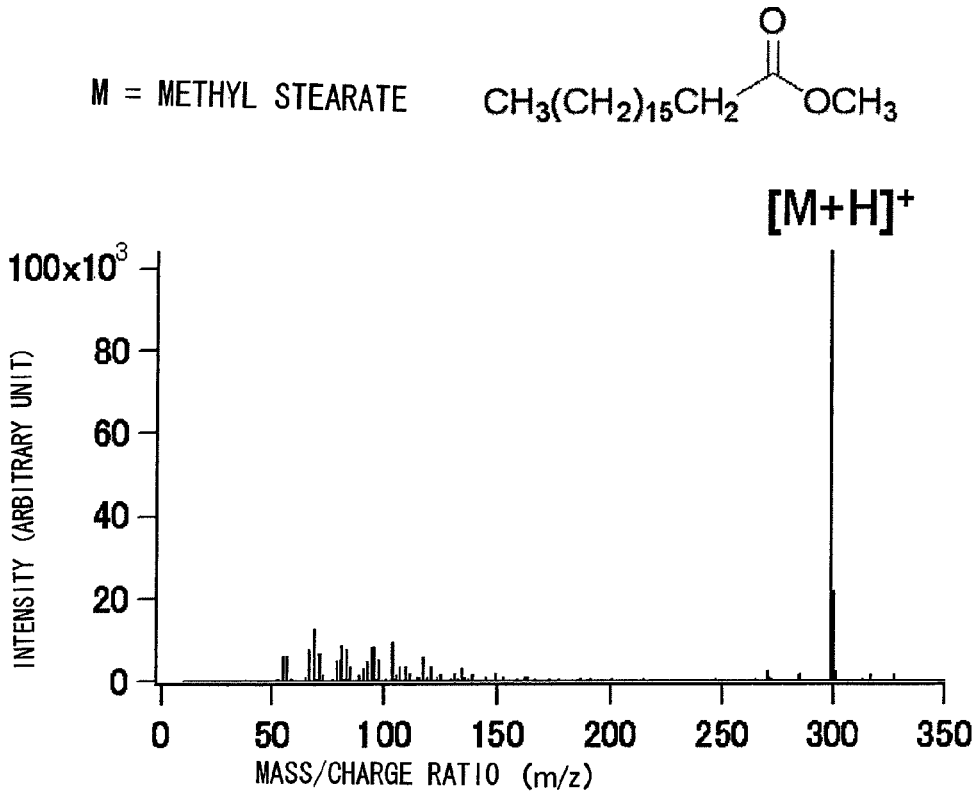
FIG. 9 is a graph obtained by analyzing methyl stearate as an example of a readily destroyed sample using the apparatus of the first embodiment.

FIG. 9 illustrates the result of analyzing methyl stearate as an example of a substance that readily gives rise to fragmentation in ionization. Almost no fragment ions appear. The group of peaks appearing where the mass/charge ratio (m/z) is 50 to 150 is ascribable to impurities and is not an indication of fragment ions.

Figure 10:
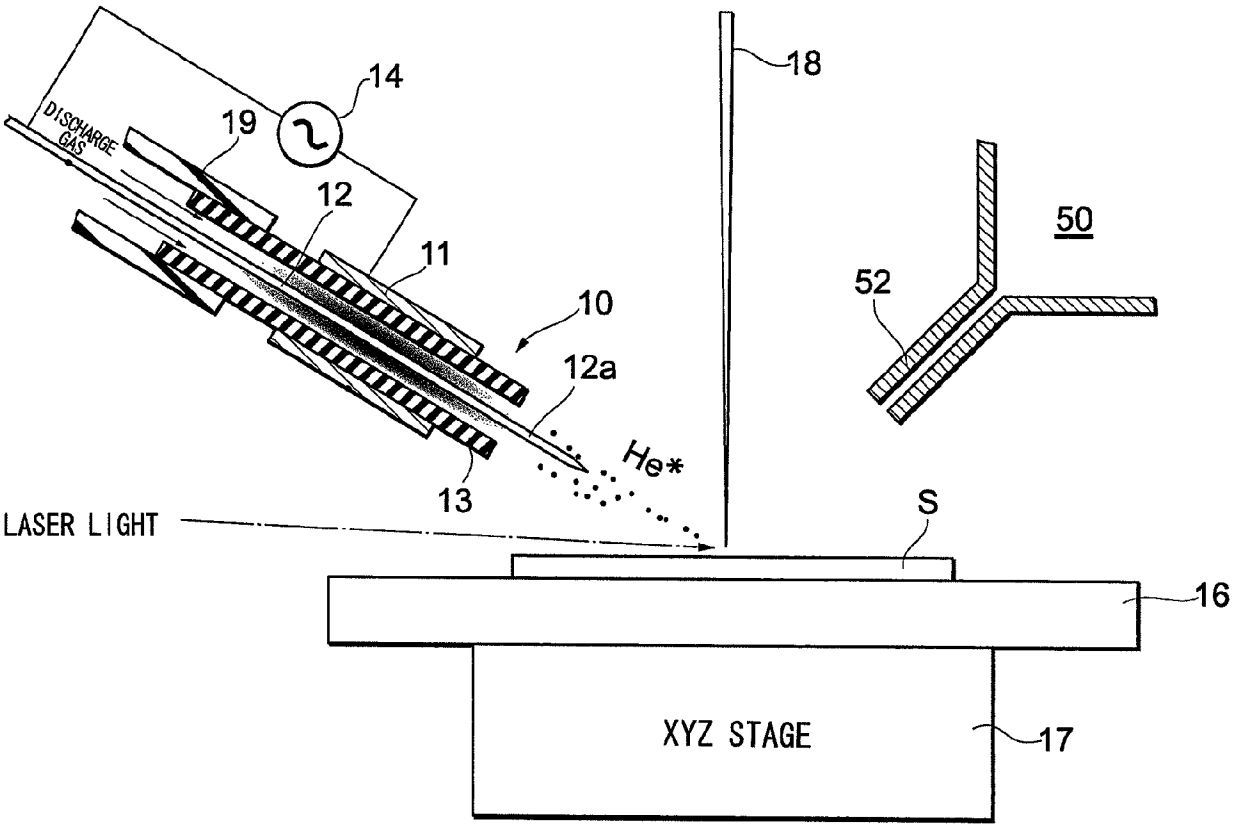
FIG. 10 illustrates a further modification of the ionization apparatus and ionization analysis apparatus according to the first embodiment.

FIG. 10 illustrates a further modification of the first embodiment, in which use is made of near-field light. Although it is known that a target sample is desorbed very efficiently by near-field light, it is difficult to ionize desorbed neutral species efficiently. This modification attempts to ionize (by Penning ionization or reactive ionization) neutral species, which have been desorbed from a sample by near-field light, by metastable excited species and ion species, etc., produced by barrier discharge.

The sample S is placed on a sample table 16. The sample table 16 is secured on an XYZ stage 17 and is movable in X, Y and Z directions. (For example, assume that the surface of the sample table 16 is the XY plane and that the direction perpendicular thereto is the Z direction).

A near-field probe 18 made of metal is supported so as to be movable up and down (the supporting mechanism is not shown). Preferably, the probe is arranged perpendicular to the surface of the sample table 16 and the tip thereof is made to approach the sample S. The diameter of the tip of probe 18 preferably is one to several nanometers, and the distance from the Lip of probe 18 to the surface of the sample is several nanometers to tens of nanometers, by way of example. The vicinity of the tip of probe 18 is irradiated from the side with a visible-light laser or ultraviolet laser (a direction substantially parallel to the sample surface). Surface plasmons excited at the surface of the irradiated probe propagate toward the probe tip and form a strong photon field at the tip (this is surface plasmon excitation). Alternatively, laser light is sent to the probe tip through an optical fiber or the like, and a strong photon field is produced at the tip. The sample in the proximity of the probe undergoes ablation and desorption occurs from the sample surface owing to the strong photon field generated at the tip of the near-field probe by the laser light.

The ionization apparatus 10 is placed at a position where the above-mentioned desorbed sample is exposed to the thermal equilibrium plasma generated from the ionization apparatus 10. Atoms (in case of an inorganic material) or molecules (in case of an organic sample or biological sample, etc.) desorbed from the sample are ionized by metastable excited species (He*, etc.) produced by barrier discharge (produced by an He-gas or other rare-gas discharge) (Penning ionization: $He^*+M \rightarrow M^+ + He + e^-$). The generated ions are introduced to and detected by the mass analyzer 50 (e.g., an ion-trap mass spectrometer) through an ion sampling capillary 52. The region of the sample S ablated has a diameter of approximately 200 nm and a depth on the order of 50 nm.

By scanning the sample-carrying stage 17 in the X, Y, Z directions and measuring the ions, an image (an imaging spectrum) of a local area of the material surface relating to each ion can be obtained. By thus performing this simple operation under atmospheric pressure, composition analysis imaging by mass analysis of atoms or molecules of a target sample becomes possible.

Since the technique of this modification does not employ an ion beam, the modification has the following features: there is no surface contamination; only the surface is ablated by the strong photon field and the interior of the sample is not damaged; imaging under atmospheric pressure becomes possible by combining the technique of desorbing the sample by the near-field strobe with a barrier discharge that is capable of ionizing the sample efficiently; and sample preparation is unnecessary. Spatial resolution is on the order of 200 nm.

With the method of barrier-discharge ionization, analysis of trace components on the femtomole order or smaller is possible. The amount of substance ablated by the near-field probe reaches several hundred femtomoles and this can be ionized by barrier discharge and subjected to mass analysis and highly sensitive measurement. If a component is a trace component, detection on the femtomole order is possible. If a component is a principal component, then detection on the attomole order is possible. Applicability to measurement of a single cell is conceivable.

Second Embodiment

Figure 11:
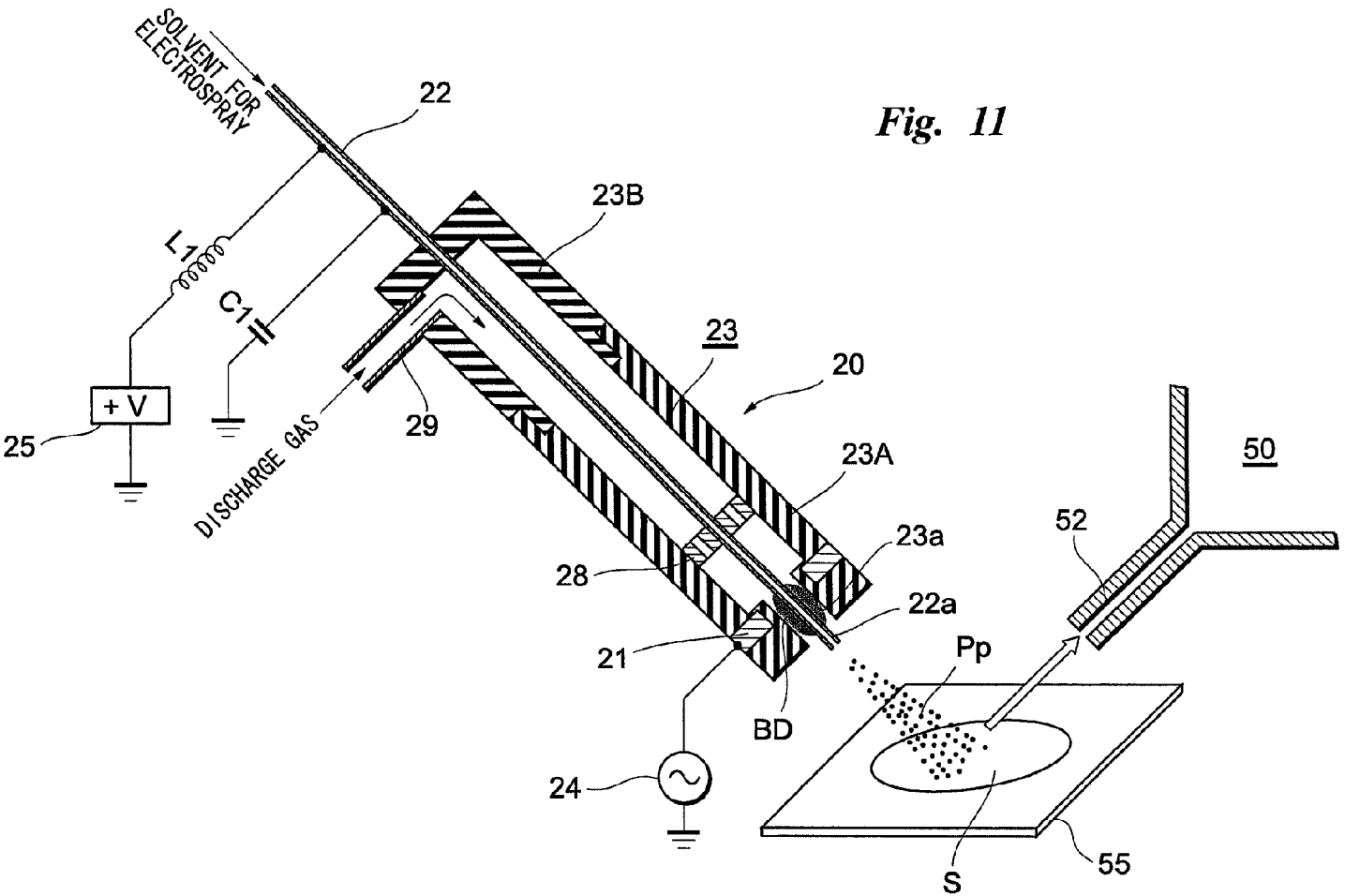
FIG. 11 illustrates an arrangement of an ionization apparatus and ionization analysis apparatus according to a second embodiment of the present invention.

FIG. 11 illustrates an arrangement of an ionization apparatus and ionization analysis apparatus according to a second embodiment. This apparatus also is of the spray type. Since the basic configuration of the apparatus and the ionization principle thereof are the same as described in the first embodiment, the aspects of this embodiment that differ will be described below.

Ionization apparatus (ionization analysis apparatus) 20 includes a cylindrical body 23 made of a dielectric and comprising a first half 23A and a second half 23B. The portions 23A, 23B are joined by being fitted together or screwed together or joined by some other method. The distal end of the cylindrical body 23 (first half 23A) is formed to be somewhat thick and is provided with a somewhat small center hole 23*a*. The outer peripheral surface of the thickly formed distal end of cylindrical body 23 (first half 23A) is formed to have an annular groove into which a first electrode (annular electrode) 21 has been fitted. The rear end face of the second half 23B of cylindrical body 23 is closed by a wall.

Disposed along the central axis of the cylindrical body 23 is a capillary 22 made of metal and acting as a combined metal capillary for electrospray and a second electrode. The capillary passes through a support member 28, which is provided inside the cylindrical body 23 (first half 23A), and the rear end wall of the cylindrical body 23 (second half 23B) and is supported by these members. The support member 28 is provided with a plurality of holes through which a discharge gas passes. The distal end portion of the capillary 22 passes through the interior of the hole 23*a* in the distal end portion of the cylindrical body 23 and projects outward from the distal end of the cylindrical body 23. (The projecting portion is indicated at reference symbol 22*a* and will be referred to as the "protruding end".) A gap exists between the inner peripheral surface of the distal end portion of cylindrical body 23 and the capillary 22.

A hole is provided in the vicinity of the rear end of the cylindrical body 23 (second half 23B) in the peripheral surface thereof and a discharge-gas supply tube 29 is connected to this hole. The interior of the cylindrical body 23 is supplied with a discharge gas from a discharge-gas supply device (not shown) through the gas supply tube 29.

An AC high voltage is impressed across the first electrode 21 and ground potential by an AC high-voltage power supply 24. Applied across the capillary (second electrode) 22 and ground potential by a DC power supply 25 via an inductance (coil) L1 is a positive DC high voltage (e.g., several kilovolts) (for electrospray) (this is a positive-ion measurement mode). A capacitor C is connected between the capillary 22 and ground (earth).

The capillary 22 is supplied from the base end thereof with a solution for electrospray (e.g., methanol, water, acetonitrile or acetic acid or a mixed solvent thereof, etc.).

By applying an AC high voltage across the first electrode 21 and capillary (second electrode) 22, a barrier discharge BD occurs and a non-equilibrium plasma is produced within the hole 23*a* at the distal end of cylindrical body 23. Since a positive DC voltage is applied to the second electrode (capillary) 22, the positive-ion-rich charged gas current Pp is jetted from the distal end of the cylindrical body 23 toward the sample S placed in front. Further, fine droplets of the electrospray solvent are jetted from the distal end of the capillary (second electrode) 22 and are sprayed onto the sample S. When the electrospray solvent is sprayed onto the sample S, a part of the sample S dissolves and the sample is vaporized (desorbed) at the same time that the solvent is vaporized. The desorbed sample is positively ionized by the positive-ion-rich charged gas current Pp. The positive ions of the sample are introduced into the mass analyzer 50 from the ion sampling capillary 52 of the mass analyzer 50 placed nearby, and the positive ions become the object of analysis.

The inductance L1 and capacitor C1 are for suppressing voltage fluctuation of the capillary 22 ascribable to application of the AC voltage but need not necessarily be provided.

In the description rendered above, desorption of the sample is promoted by electrospray. However, a variety of methods for promoting desorption are available. For example, a sample table (or substrate) 55 on which the sample S has been placed is heated and the solid sample is vaporized by the Leidenfrost phenomenon; the sample table (substrate) 55 is subjected to ultrasonic vibration; near-field light is utilized, as mentioned above; or the sample is irradiated with laser light, as will be described later in a third embodiment.

Figure 12:
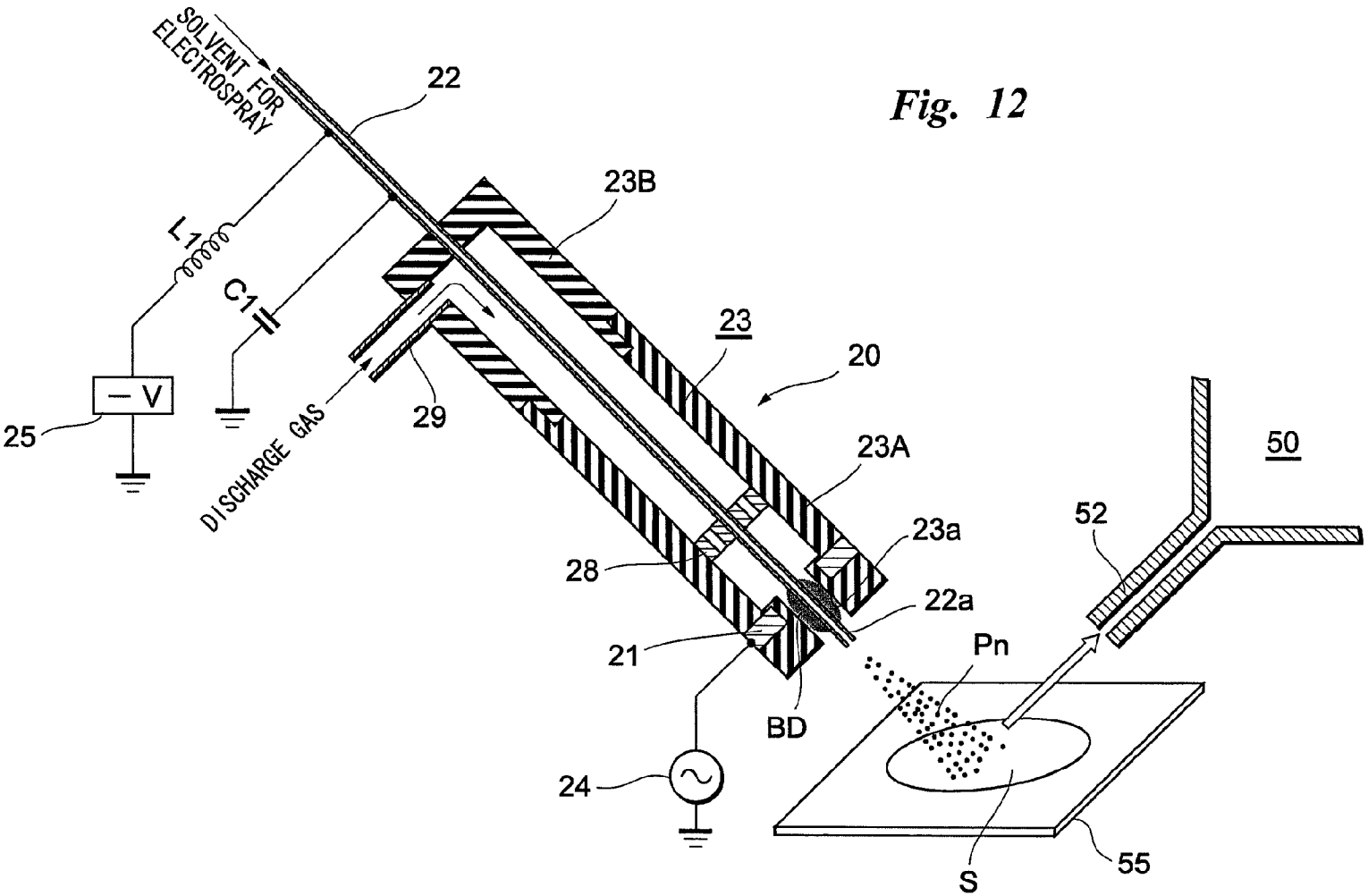
FIG. 12 illustrates a modification of the ionization apparatus and ionization analysis apparatus according to the second embodiment.

FIG. 12 illustrates the arrangement of the negative-ion measurement mode in which a negative DC voltage is applied to the capillary (second electrode) 22 by the DC voltage generating device 25. The negative-ion-rich charged gas current Pn is jetted from the distal end of the cylindrical body 23, particles desorbed from the sample S are ionized mainly into negative ions and these are introduced into the mass analyzer 50.

The positive-ion measurement mode and the negative-ion measurement mode are implemented if the polarity of the DC voltage applied to the second electrode 22 is changed over. In the description that follows, therefore, the two modes will be described without particularly differentiating between them. Further, the positive-ion-rich charged gas current Pp and negative-ion-rich charged gas current Pn are not shown as long as there is no particular need to do so.

Figure 13:
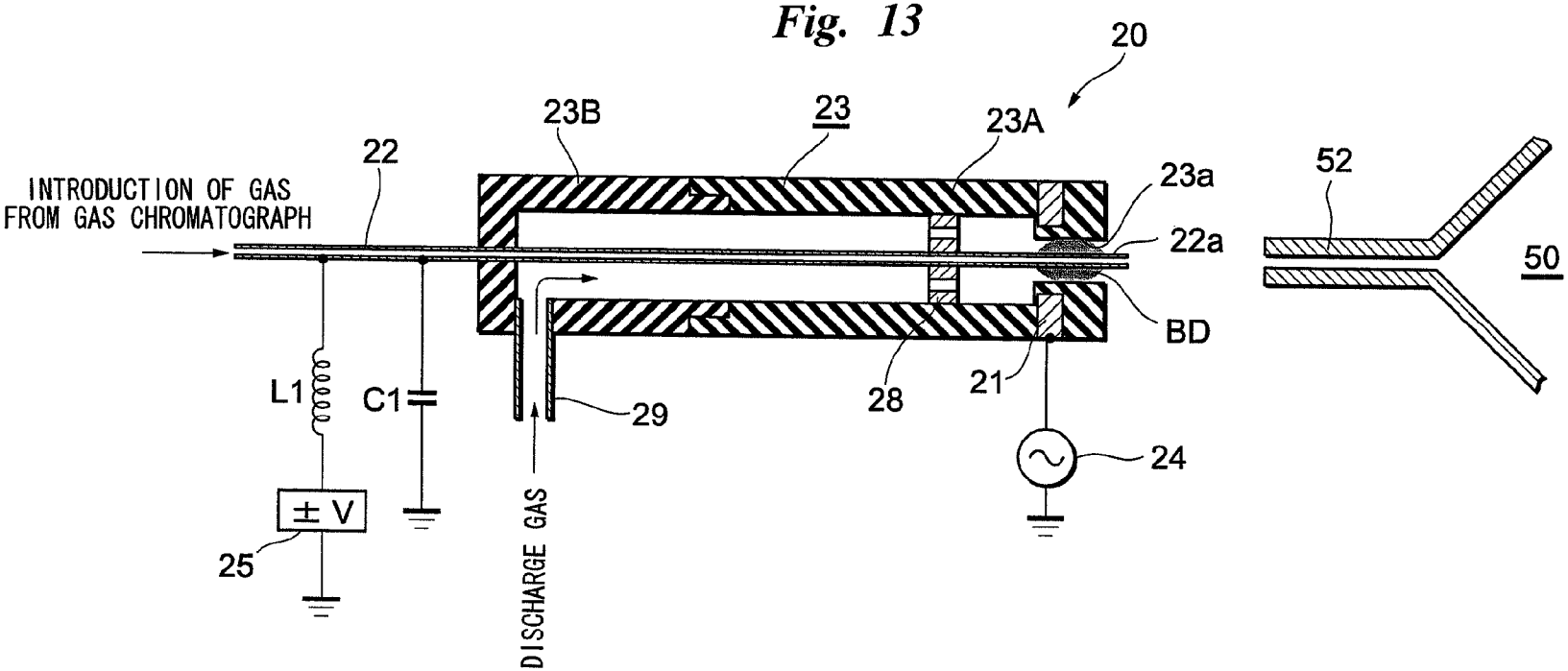
FIG. 13 illustrates another modification of the ionization apparatus and ionization analysis apparatus according to the second embodiment.

FIG. 13 illustrates a modification of the second embodiment.

A gas that is output from a gas chromatograph is introduced to the capillary 22. The gas flows out from the distal end of the capillary 22. If a positive DC voltage is applied to the capillary 22 by the DC power supply 25, a positive-ion-rich charged gas current is produced outwardly of the distal end of the cylindrical body 23 (positive-ion measurement mode). If a negative DC voltage is applied, a negative-ion (and electron)-rich charged gas current is produced outwardly of the distal end of the cylindrical body 23 (negative-ion measurement mode). Accordingly, the gas from the gas chromatograph that flows out from the distal end of capillary 22 is positively ionized or negatively ionized in accordance with the above-mentioned mode and is introduced to the mass analyzer 50 through the ion sampling capillary 52.

Figure 14:
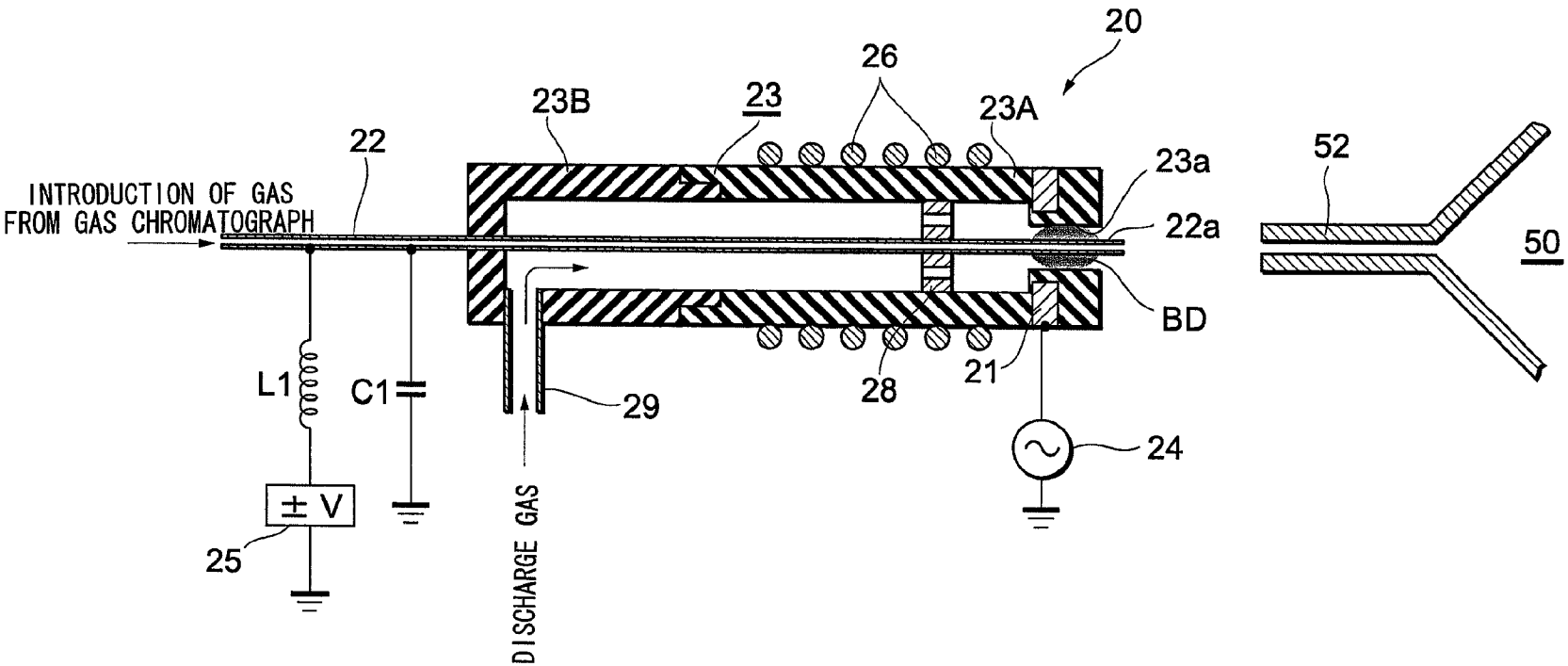
FIG. 14 illustrates a further modification of the ionization apparatus and ionization analysis apparatus according to the second embodiment.

FIG. 14 illustrates a further modification of the arrangement shown in FIG. 13. The outer periphery of the cylindrical body 23 is provided with a heater (heating device) 26 so that the discharge gas that passes through the interior of the cylindrical body 23 is heated (e.g., from 100 to 300° C.). As a result, the sample to be analyzed (which, in this embodiment, is the gas introduced from the gas chromatograph) is heated and easily vaporized. This is particularly effective in a case where the sample is a substance exhibiting a refractory property.

Figure 15:
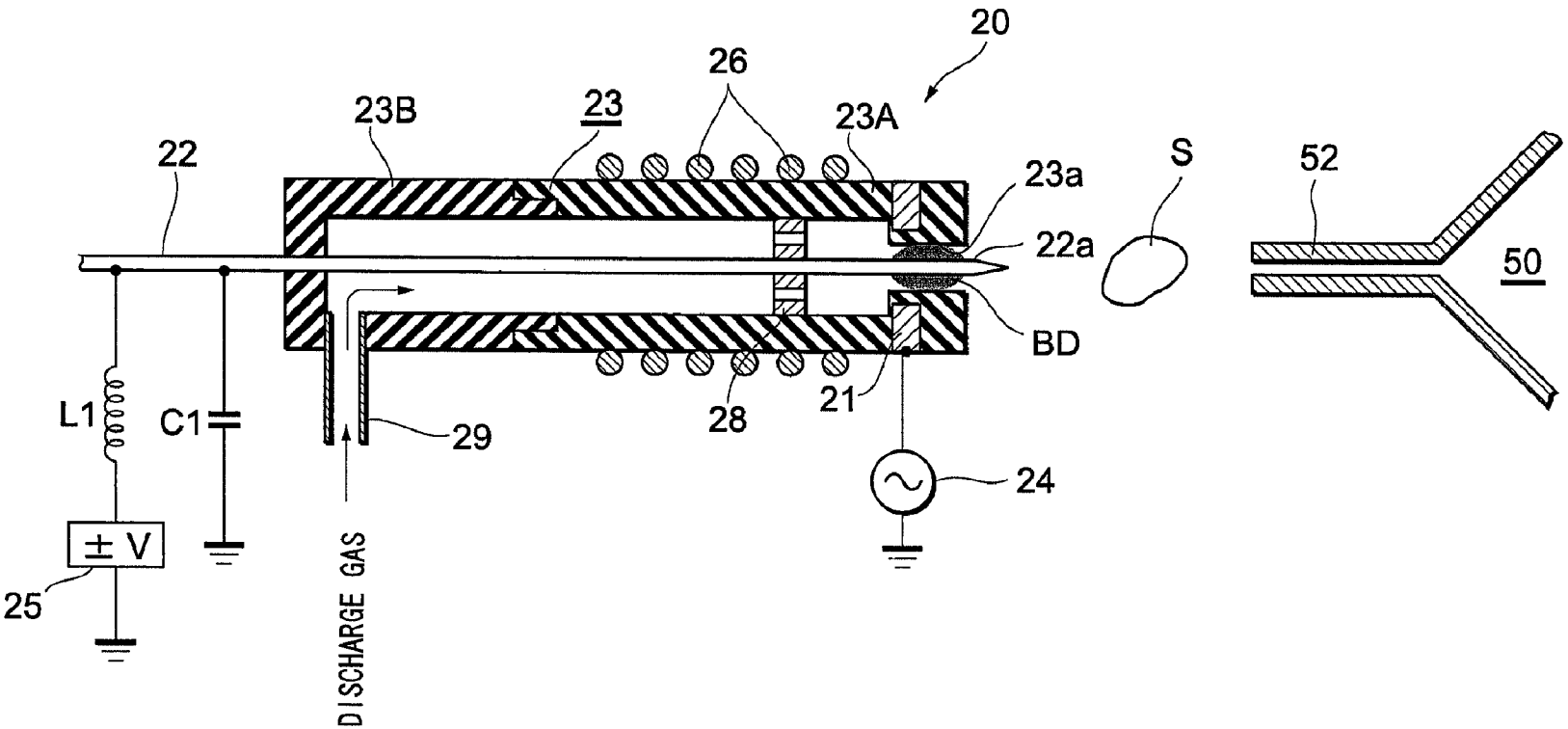
FIG. 15 illustrates a further modification of the ionization apparatus and ionization analysis apparatus according to the second embodiment.

FIG. 15 illustrates a further modification.

The second electrode 22 is a needle-shape electrode and is not a capillary. The sample S to be analyzed is placed between the ionization apparatus 20 (cylindrical body 23) and the ion sampling capillary 52. This is an arrangement ideal for exposing a sample for a sampling test or the like to a charged gas current jetted from the cylindrical body 23 and then ionizing and analyzing the vapor from the sample S. In the modification shown in FIG. 15 and a modification shown in FIG. 16, a DC voltage need not necessarily be applied to the needle-shaped electrode 22.

Figure 16:
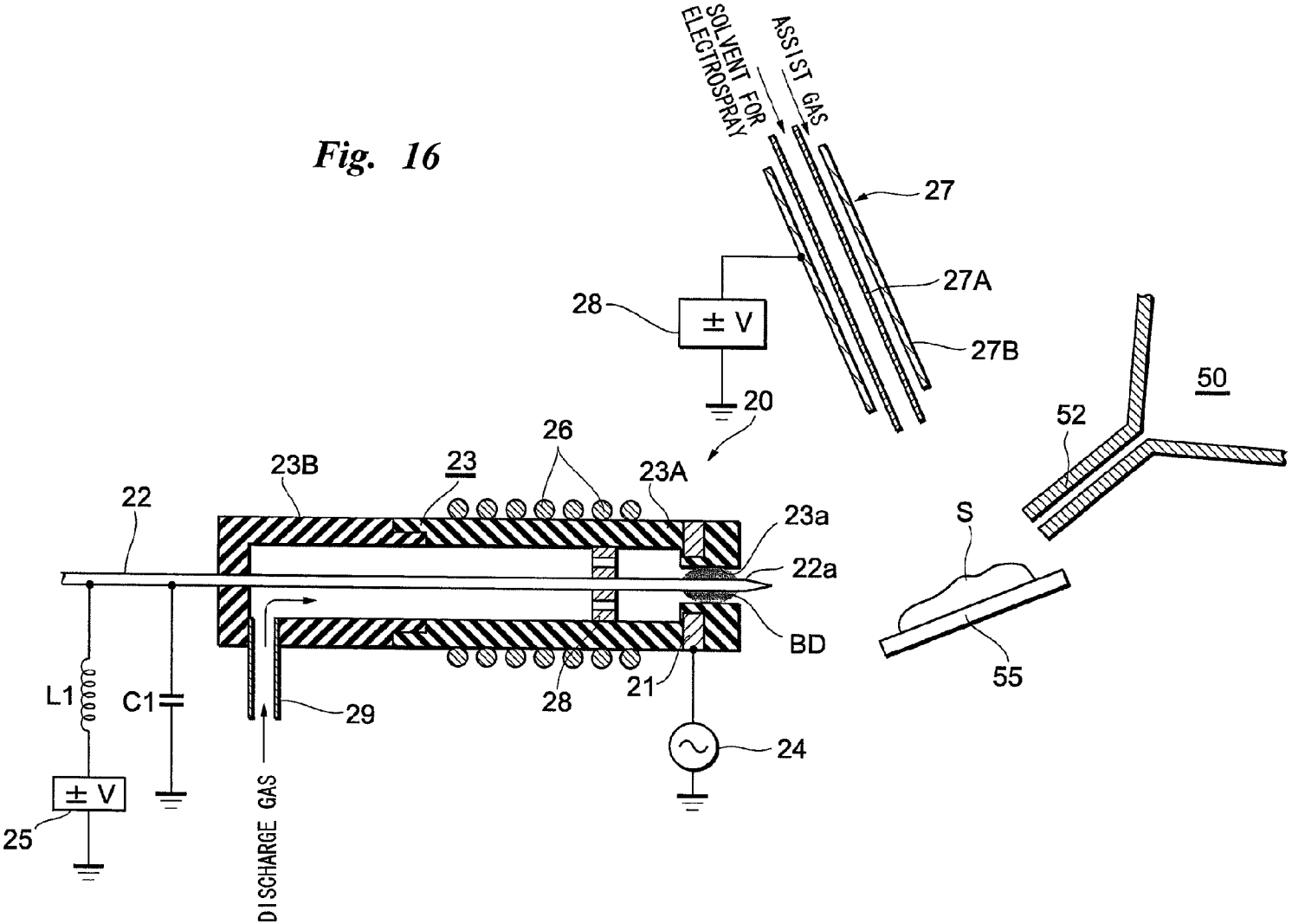
FIG. 16 illustrates a further modification of the ionization apparatus and ionization analysis apparatus according to the second embodiment.

FIG. 16 shows a further modification.

The second electrode 22 placed inside the cylindrical body 23 is a needle-shaped electrode just as in the modification shown in FIG. 15. An electrospray apparatus 27 is provided separate from the cylindrical body 23. The electrospray apparatus 27 is a double-pipe structure. A solvent for electrospray is introduced into the inner pipe, and an assist gas (carrier gas) (nitrogen, for example) for carrying fine electrosprayed droplets toward the sample S is introduced into an outer pipe 27B (into the space between the inner pipe and the outer pipe). A positive or negative high voltage is applied to one or both of inner pipe 27A and outer pipe 27B by a DC voltage generating device 28.

The electrospray apparatus 27 promotes desorption from the sample S. In order to promote desorption, use is made of ultrasonic vibration of the substrate (or sample table) 55 of sample S, heating, irradiation of the sample S with a laser light, or utilization of near-field light, etc., as mentioned earlier.

It goes without saying that the capillary 52 of mass analyzer 50 is placed at a position where sample ions that have been desorbed from the sample S and then ionized by the charged current jetted from the cylindrical body 23 are easily sampled.

Figure 17:
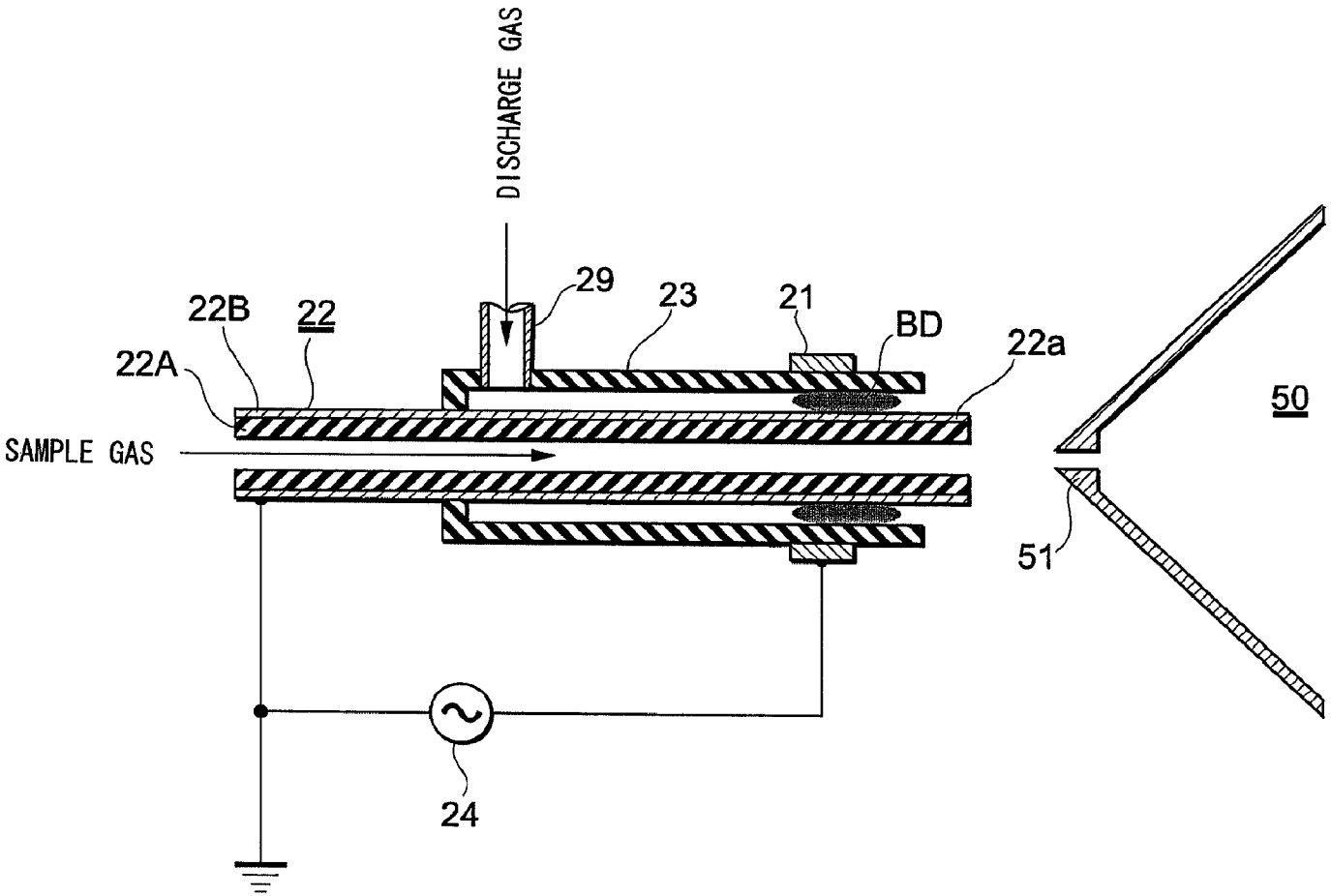
FIG. 17 illustrates a further modification of the ionization apparatus and ionization analysis apparatus according to the second embodiment.

FIG. 17 illustrates a further modification. Basically, this modification is suited to ionization and mass analysis of a gas sample in a manner the same as that of the modification shown in FIG. 13. The cylindrical body 23 made of a dielectric (insulator) and the shape of the ion sampling orifice 51 of mass analyzer 50 are somewhat different from those of the above-described modification. The distal end portion of the cylindrical body (outer cylinder or outer pipe) (referred to as "outer cylindrical body" below) is not formed to have a thick portion. The first electrode 21 is formed annularly on the outer periphery of the distal end portion of the outer cylindrical body 23. A discharge gas (e.g., He gas) is supplied from the gas supply tube 29 provided at the rear end portion of the outer cylindrical body 23, and the discharge gas flows in the forward direction through the interior of the outer cylindrical body 23 (strictly speaking, through the gap between the outer cylindrical body 23 and an inner cylindrical body 22, described next.

The inner cylindrical body (inner cylinder or inner pipe) 22, which has a diameter smaller than that of the outer cylindrical body 23, is disposed coaxially inside the outer cylindrical body 23 and is supported by the rear end wall of the outer cylindrical body 23 and a support member (like the support member 28) (not shown) while the clearance between the inner cylindrical body and the inner peripheral surface of the outer cylindrical body 23 is maintained. The inner cylindrical body 22 comprises a cylinder 22A, which exhibits an insulating property, and a metal cylindrical electrode (or metal film) (second electrode) 22B formed on the entirety of the outer peripheral surface of the cylinder 22A. The distal end portion of the inner cylindrical body 22 projects forwardly of the distal end portion of the outer cylindrical body 23 [it will suffice if at least a portion (indicated at reference symbol 22*a*) of the cylindrical electrode 22B protrudes]. It is so arranged that the opening of the ion sampling orifice 51 of mass analyzer 50 faces the distal end portion 22*a* of the inner cylindrical body 22 across a small gap. The rear end portion of the inner cylindrical body 22 projects rearwardly through the rear end wall of the outer cylindrical body 23. A sample gas is introduced into the inner cylindrical body 22 from the rear portion of the inner cylindrical body 22. The sample gas is not limited to a gas from a gas chromatograph. The inner cylindrical body 22 may be referred to as a "capillary" in the same manner as the capillary 22 shown in FIG. 13. The reason is that whether it is slender or not is a relative concept.

In this modification, the second electrode 22B is grounded and a high-frequency high voltage for barrier discharge is impressed across the first electrode 21 and second electrode 22B by the power supply 24. The barrier discharge BD occurs across the outer cylindrical body 23 and inner cylindrical body 22 (second electrode 22B) at a position inside the first electrode 21 and a thermal equilibrium plasma is produced outwardly of the distal end of inner cylindrical body 22 owing to the flow of discharge gas. Since the sample gas is supplied beyond the distal end of the inner cylindrical body 22 through the inner cylindrical body 22, the sample gas is ionized by metastable excited species, etc., in the thermal equilibrium plasma P. These ions are drawn into the mass analyzer 50 through the orifice 51 and are subjected to analysis.

Figure 18:
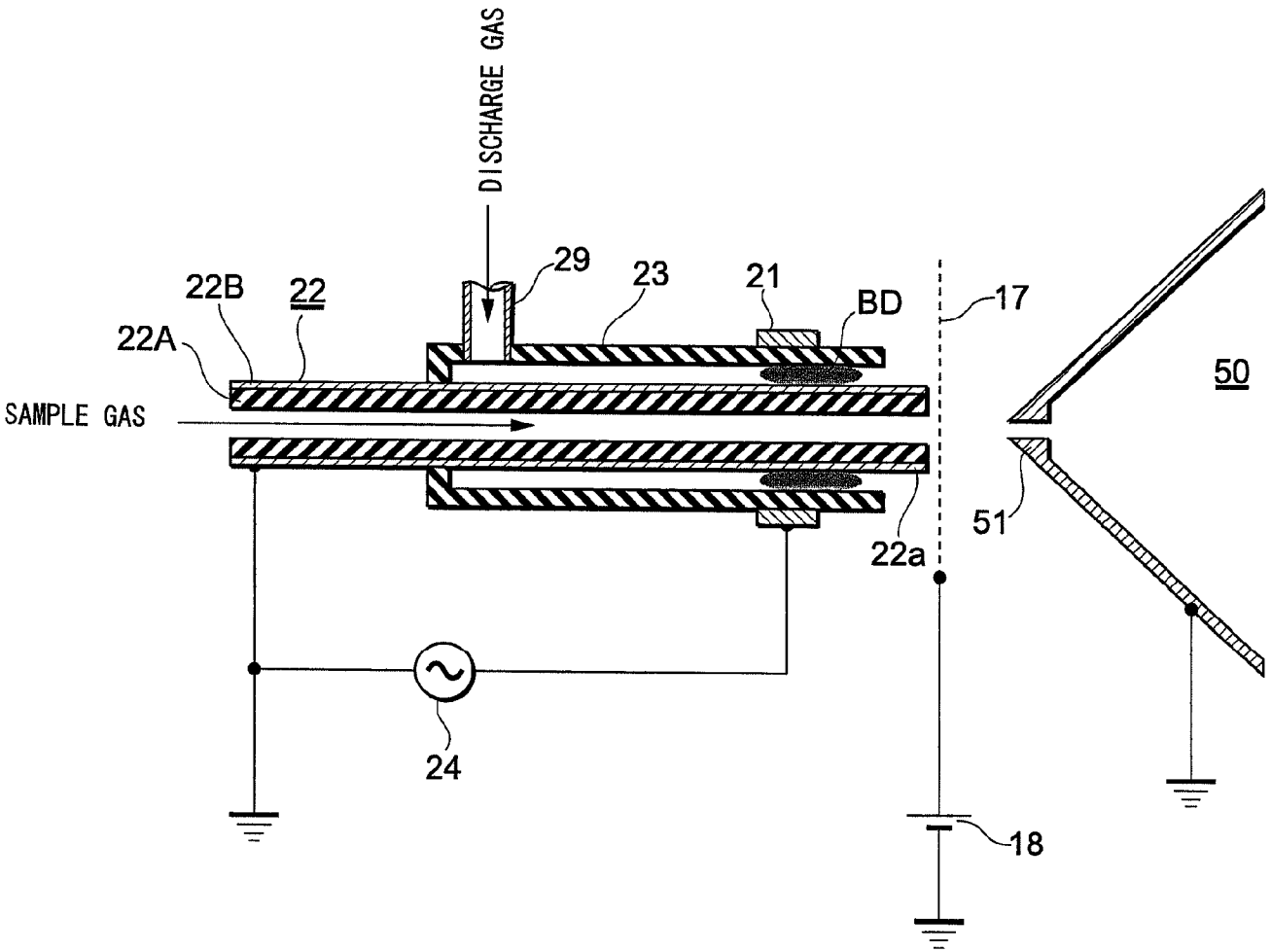
FIG. 18 illustrates a further modification of the ionization apparatus and ionization analysis apparatus according to the second embodiment.

FIG. 18 illustrates an improvement upon the ionization apparatus and ionization analysis apparatus shown in FIG. 17. A mesh electrode 17 is disposed in close proximity to the distal end portion 22*a* (leaving a small gap) of inner cylindrical body 22 (second electrode 22B) between the distal end of inner cylindrical body 22 and the ion sampling orifice 51. FIG. 18 illustrates the arrangement of the positive-ion measurement mode, in which a positive potential is applied to the mesh electrode 17 by DC power supply 18. In the arrangement of the negative-ion measurement mode, a negative potential is impressed upon the mesh electrode 17. The sampling orifice 51 is grounded.

A variety of ions tend to be produced from the barrier discharge plasma BD and if these should be introduced into the mass analyzer 50, they may appear as background ions in the measurement spectrum and there may be instances where they cannot be distinguished from the signal ascribable to the sample. Selectively removing only the ions produced by the plasma BD is desirable. The mesh electrode 17 makes this possible.

Positive ions produced by the barrier discharge plasma BD are repelled by the mesh electrode 17 at the positive potential and are thereby removed from the system without flowing in the direction of the ion sampling orifice.

Penning ionizing, etc., due to metastable excited species (He*, for example) produced by the barrier discharge plasma BD occurs between the mesh electrode 17 and orifice 51, the sample ions $M^+$ ($He^*+M \rightarrow He+M^++e^-$) generated thereby are thrust out in the ion sampling direction by the electric field formed by the mesh electrode 17 and move in the direction of the ion sampling orifice 51 efficiently and are introduced into the mass analyzer 50. This leads to an increase in ion intensity in mass analyzer 50. The mesh electrode 17 not only enables removal of ions generated by the barrier discharge plasma BD but also serves to thrust the sample-derived ions produced by Penning ionization toward the ion sampling orifice of the mass analyzer. The mesh electrode is applicable to all of the embodiments and modifications in this specification. The technical term "mesh electrode" covers a grid-like electrode (in which a number of parallel conductors are arranged in parallel in spaced-apart relation, or in which conductors intersecting these are added) and a plate-shaped conductor provided with a number of holes, etc. The mesh electrode is one type of grid.

Third Embodiment

Figure 19:
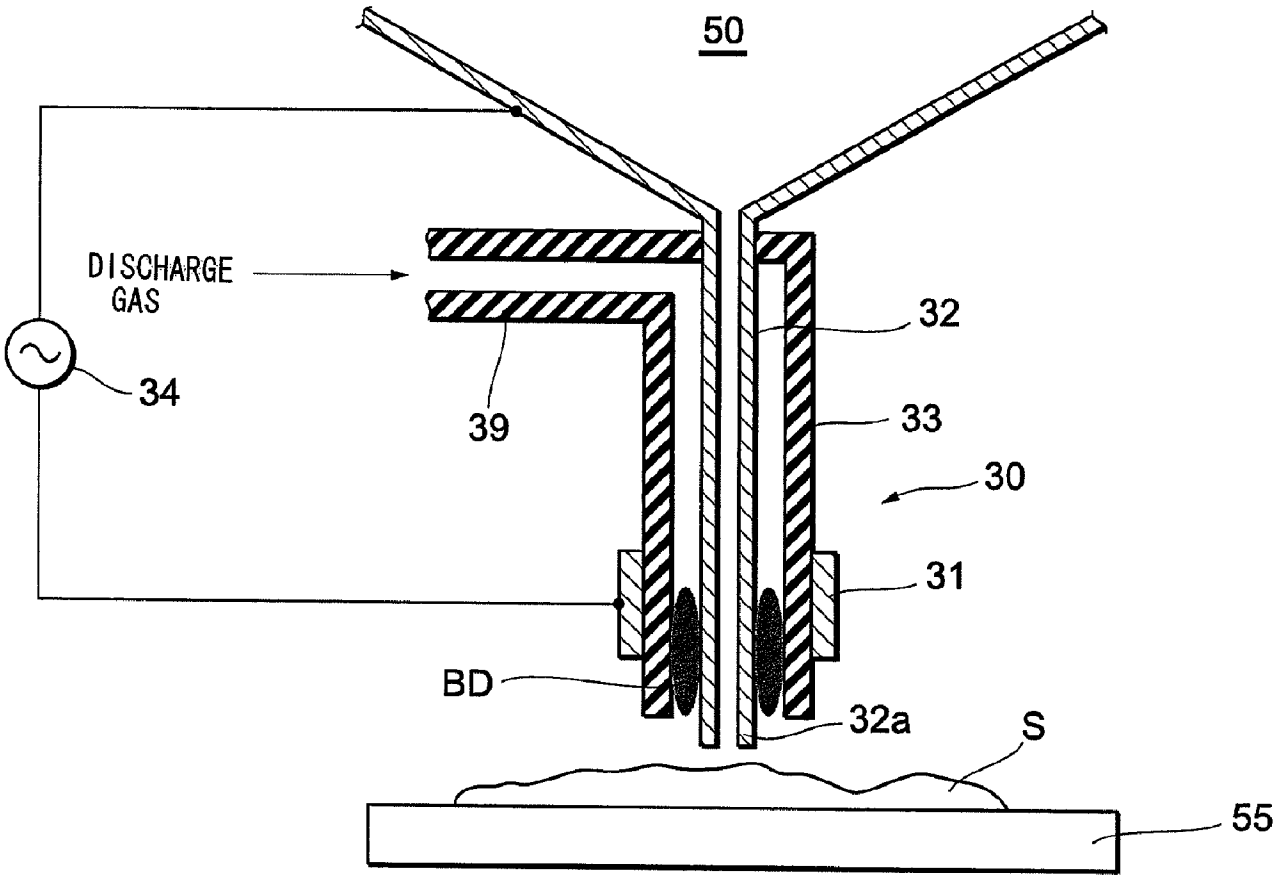
FIG. 19 illustrates an arrangement of an ionization apparatus and ionization analysis apparatus according to a third embodiment.

FIG. 19 illustrates the basic arrangement of an ionization apparatus and ionization analysis apparatus according to a third embodiment. The third embodiment is a type in which ionized sample ions are drawn into a mass analyzer utilizing the vacuum system of the mass analyzer.

In an ionization apparatus (ionization analysis apparatus) 30, a second electrode 32 serves also as an ion sampling capillary of the mass analyzer 50. The capillary 32 is made of metal (or a conductor), as a matter of course. A cylindrical body 33 made of a dielectric is placed about the periphery of the capillary 32 leaving a clearance between them and is supported on the capillary 32. A discharge-gas supply tube 39 is connected to the base end of the cylindrical body 33, and a discharge gas is supplied to the cylindrical body 33. An annular-shaped first electrode 31 is provided about the outer peripheral surface of the cylindrical body 33 near the distal end portion thereof. An AC high voltage is impressed across the first electrode 31 and second electrode 32 by an AC high-voltage power supply 34. The second electrode, namely a distal end portion 32*a* of capillary 32, projects outwardly from the distal end of the cylindrical body 33.

As mentioned above, a thermal equilibrium plasma is jetted from the distal end portion of the cylindrical body 33 and is sprayed toward the sample S. Particles (atoms, molecules, etc.) desorbed from the sample S are ionized by matastable excited species and ion species, etc., in the thermal equilibrium plasma. Since the interior of the mass analyzer 50 is in vacuum, the ionized sample ions generated are introduced by this negative pressure into the mass analyzer 50 through the capillary 32 and analyzed.

Figure 20:
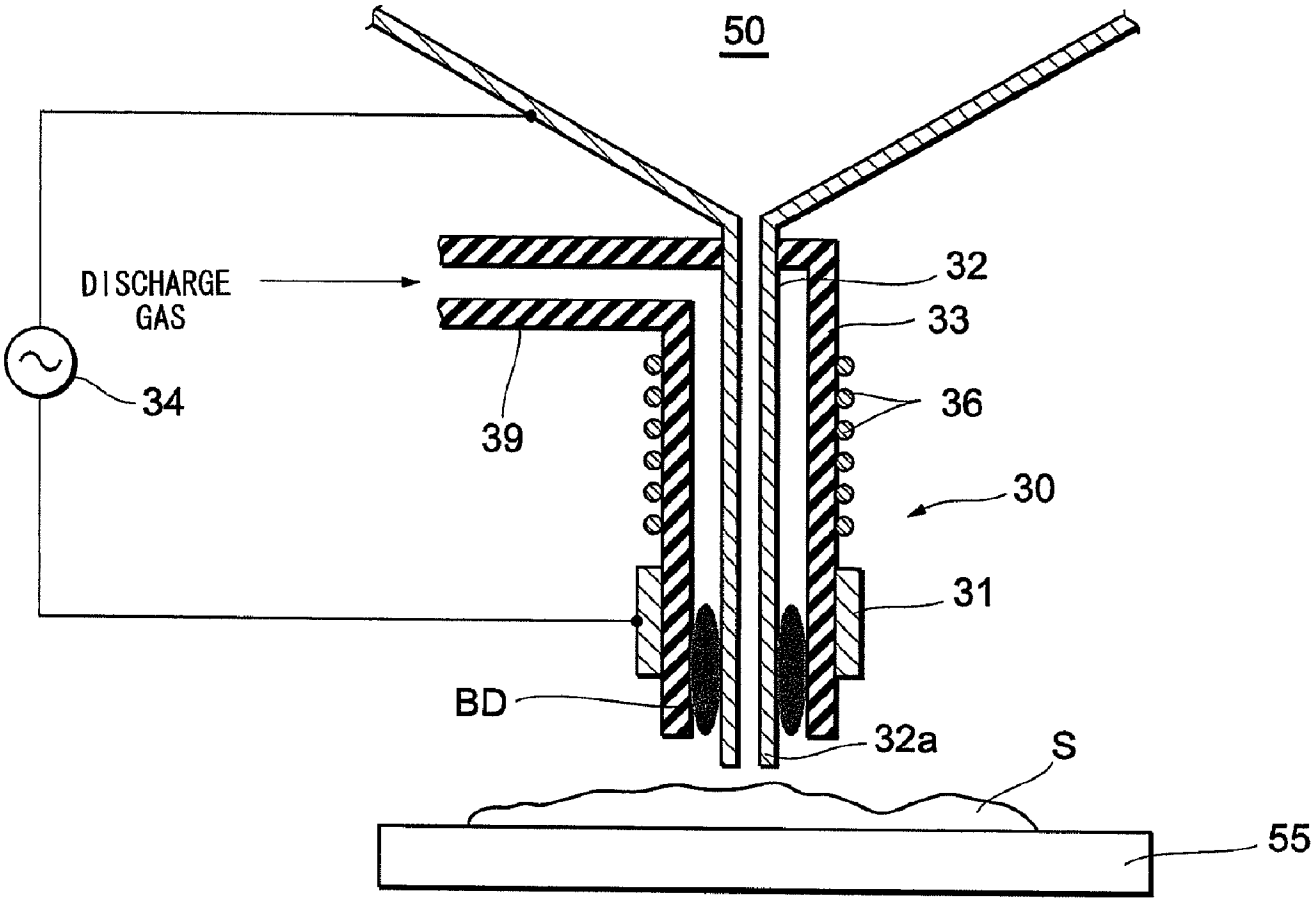
FIG. 20 illustrates a modification of the ionization apparatus and ionization analysis apparatus according to the third embodiment.

FIG. 20 illustrates a modification.

A heating device 36 is provided about the periphery of the cylindrical body 33 and a discharge gas that flows through the interior of the cylindrical body 33 is heated. In this way the desorption of the sample S is facilitated, as described above.

Figure 21:
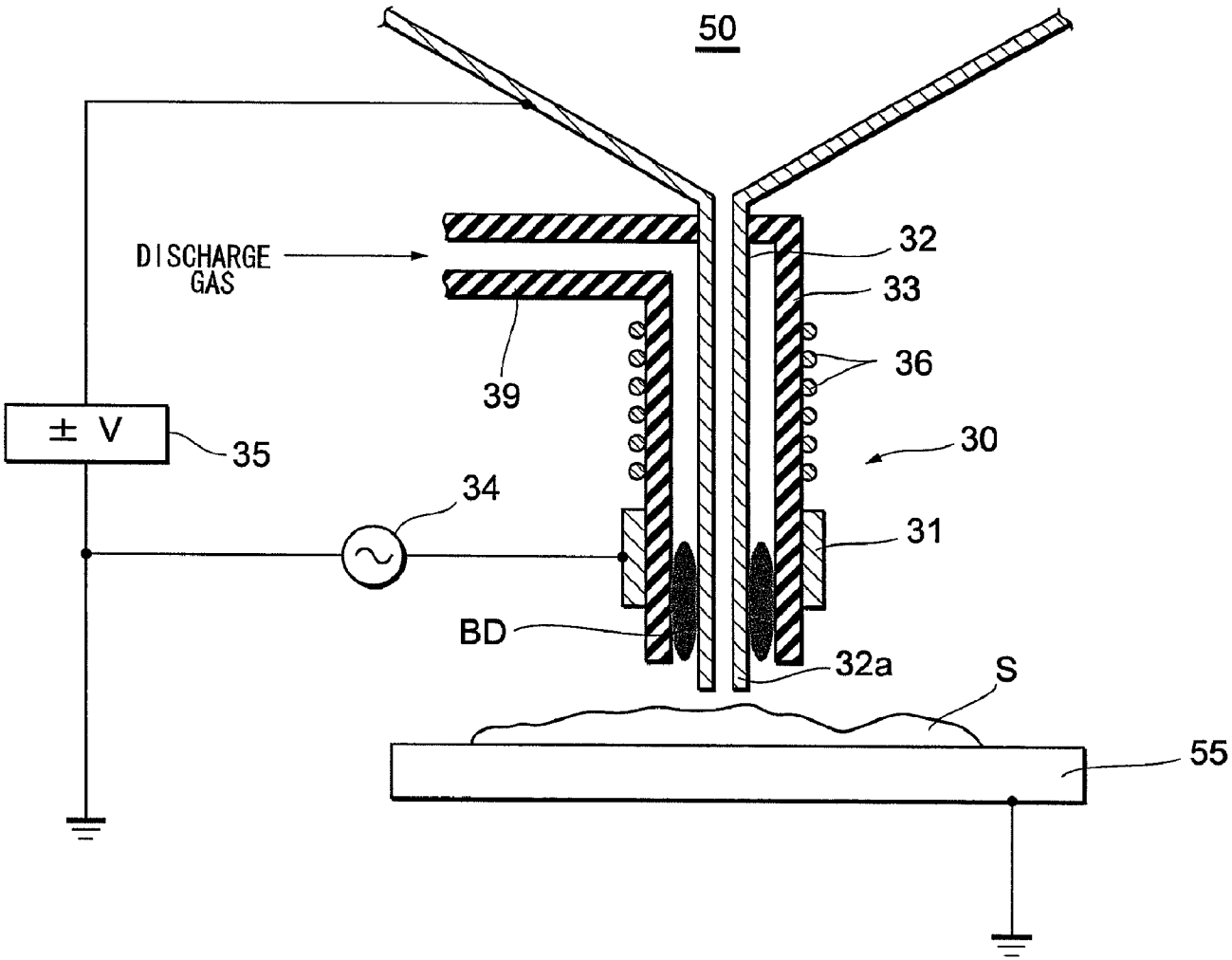
FIG. 21 illustrates another modification of the ionization apparatus and ionization analysis apparatus according to the third embodiment.

FIG. 21 illustrates another modification.

In the arrangements of FIGS. 19 and 20, the first and second electrodes 31, 32 and the sample table 55 all are at a floating potential. In the embodiment shown in FIG. 21, however, the substrate or sample table 55 is grounded (it is preferred that the sample table be formed by a conductor) (this may be left at a floating potential in the manner illustrated in FIGS. 19, 20). Further, a DC voltage power supply device 35 is connected between the second electrode 32 and AC high-voltage power supply 34 (the point at which the two power supplies 34 and 35 are connected is grounded) and it is possible to set or switch between the positive-ion measurement mode and the negative-ion measurement mode by switching between the positive and negative sides of the applied DC voltage.

Figure 22:
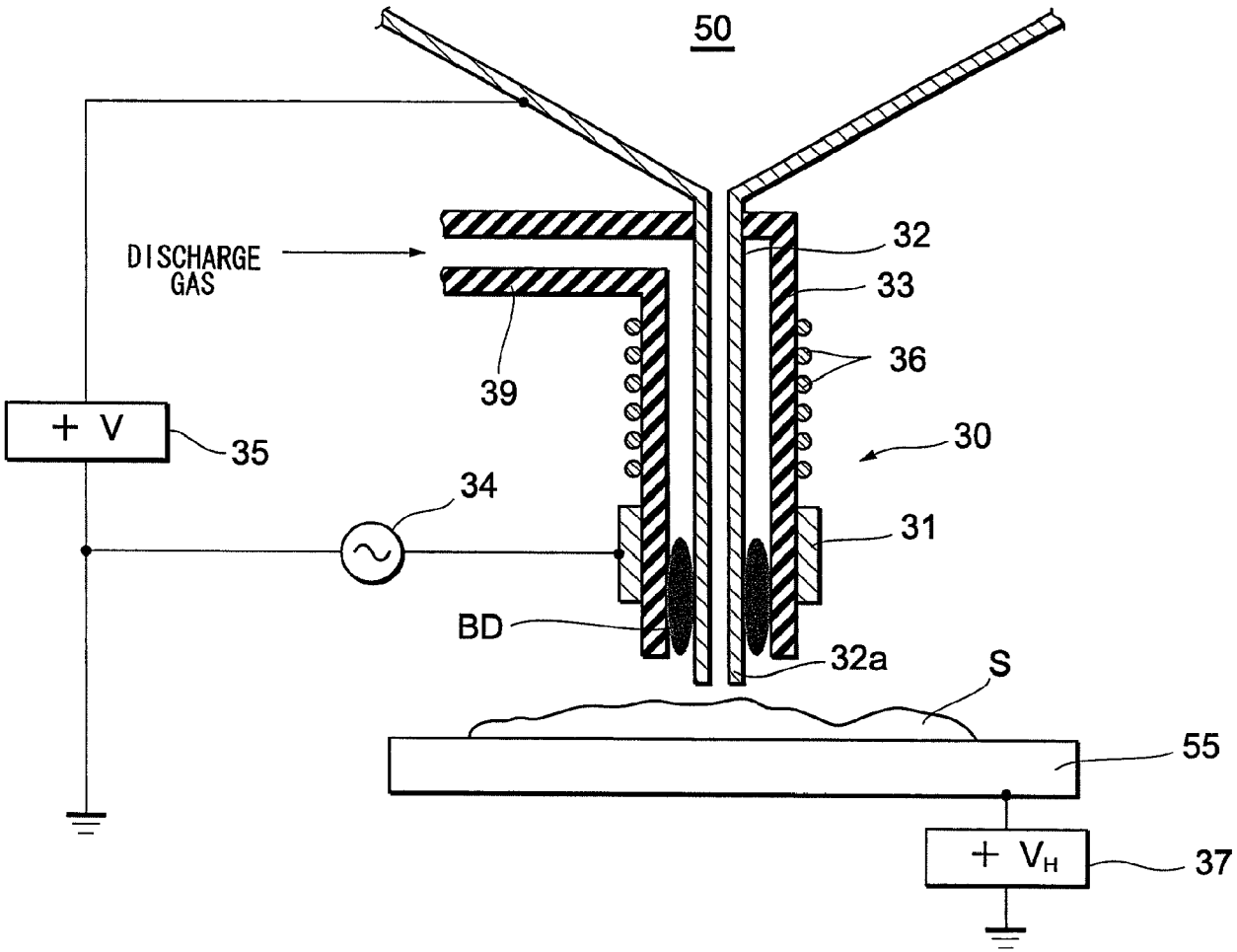
FIG. 22 illustrates a further modification of the ionization apparatus and ionization analysis apparatus according to the third embodiment.

In a modification shown in FIG. 22, the sample table (or substrate) 55 is formed by a conductor and a positive voltage higher than that of the DC power supply device 35 is applied thereto by a DC power supply device 37. By way of example, the voltage applied to the sample table 55 by the DC power supply device 37 is +300V, and the voltage applied to the second electrode 32 by the DC power supply device 35 is +100V.

This ionization apparatus (ionization analysis apparatus) 30 operates in the positive-ion measurement mode. Particles desorbed from the sample S are ionized into positive ions by the positive-ion-rich charged gas current jetted from the cylindrical body 33. (It goes without saying that positive ions are produced by Penning ionization as well.) By placing the potential of the sample table 55 (namely, sample S) at a potential having a higher positive than that of the ion sampling capillary (second electrode) 32, the positive ions produced are acted upon by a repulsive force ascribable to the higher positive potential of the sample table 55 and are introduced into the interior of the capillary 32 more easily. That is, the positive-ion collecting effect is enhanced.

Figure 23:
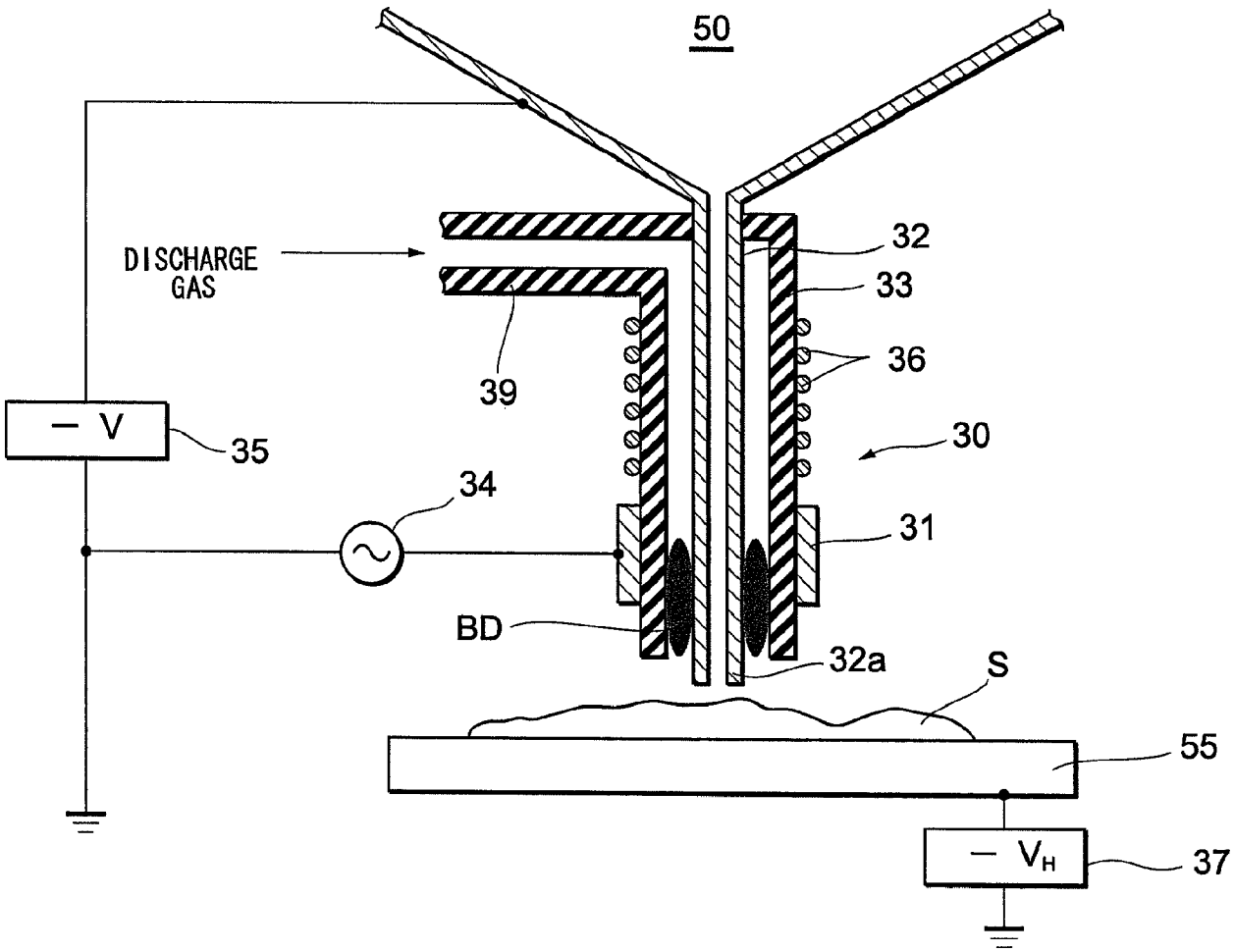
FIG. 23 illustrates a further modification of the ionization apparatus and ionization analysis apparatus according to the third embodiment.

In a modification shown in FIG. 23, a higher negative voltage than that of the DC power supply device 35 is applied by the DC power supply device 37, which is the opposite of the modification described above. By way of example, the voltage applied to the sample table 55 by the DC power supply device 37 is −300V, and the voltage applied to the second electrode 32 by the DC power supply device 35 is −100V.

This ionization apparatus (ionization analysis apparatus) 30 operates in the negative-ion measurement mode. Particles desorbed from the sample S are ionized into negative ions by the negative-ion (inclusive of electrons)-rich charged gas current jetted from the cylindrical body 33. By placing the potential of the sample table 55 (namely, sample S) at a potential higher in the negative direction than the potential of the ion sampling capillary (second electrode) 32, the negative ions produced are acted upon by a repulsive force ascribable to the higher negative potential of the sample table 55 and are introduced into the interior of the capillary 32 more easily. That is, the negative-ion collecting effect is enhanced.

Figure 24:
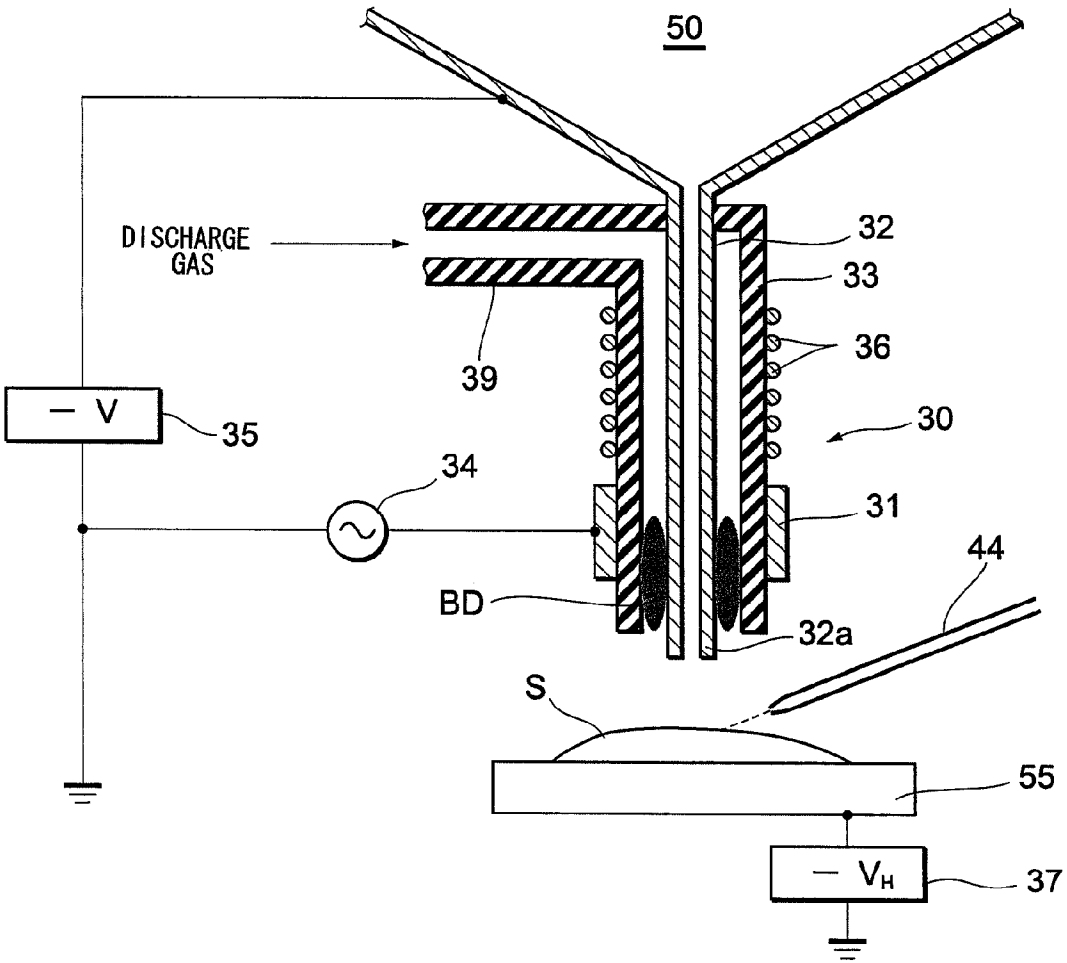
FIG. 24 illustrates a further modification of the ionization apparatus and ionization analysis apparatus according to the third embodiment.

FIG. 24 illustrates a further modification. In order to promote the desorption of the sample S, the apparatus of the negative-ion measurement mode shown in FIG. 23 sprays fine droplets of a solvent upon the sample S using a nanoelectrospray 44. The spraying of the solvent can make use of a microjet nozzle, by way of example.

Preferably, the sample table 55 is freely movable in three mutually orthogonal directions X, Y, Z by a manipulator or the like. (For example, assume that the longitudinal direction of the ion sampling capillary 32 is the Z direction and that the two directions orthogonal thereto are the X and Y directions.) By spraying the solvent onto a minute area and displacing this sprayed area, the analyzed region of the sample is changed successively and imaging (nano-imaging) becomes possible. It can be so arranged that the location sprayed by the electrospray device 44 is changed rather than the sample table 55 being moved. Spraying the solvent is particularly ideal in case of a sample exhibiting a refractory property.

Figure 25:
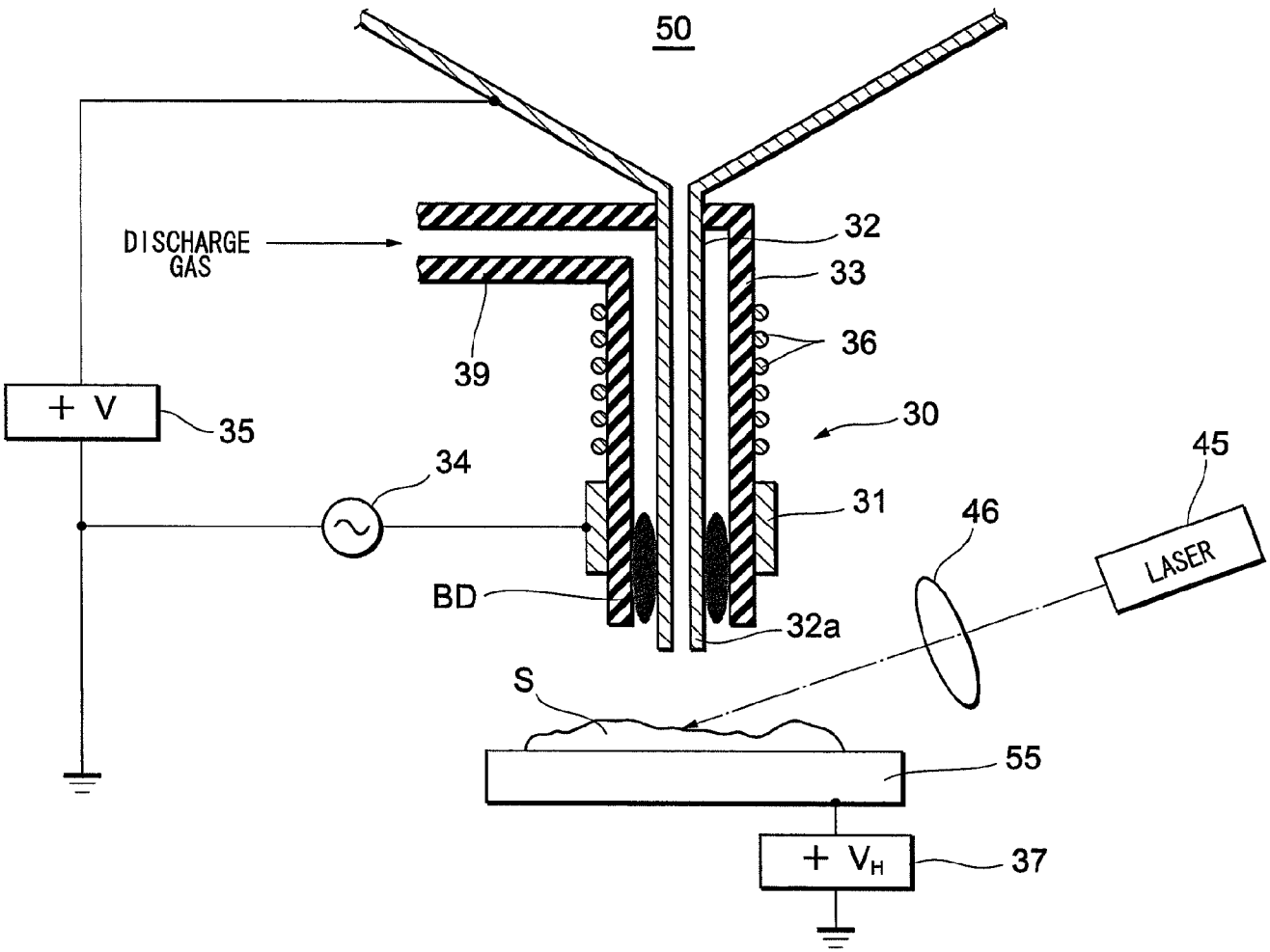
FIG. 25 illustrates a further modification of the ionization apparatus and ionization analysis apparatus according to the third embodiment.

A modification shown in FIG. 25 is such that in order to promote the desorption of the sample S in the apparatus of the positive-ion measurement mode shown in FIG. 22, use is made of laser light.

Laser light emitted from a laser device 45 is gathered by a lens system 46 and irradiates a very small area (point) on the surface of the sample S. Desorption (evaporation, sublimation) from the surface of the sample S is promoted by heating resulting from the laser light. Light of various wavelengths, such as infrared (e.g., 10.6 μm, 2.9 μm), visible light (532 nm) and ultraviolet light (337 nm, 355 nm), can be used as the laser light in accordance with the sample.

Imaging also is possible by moving the location irradiated with the laser light or by displacing the sample table 55.

Figure 26:
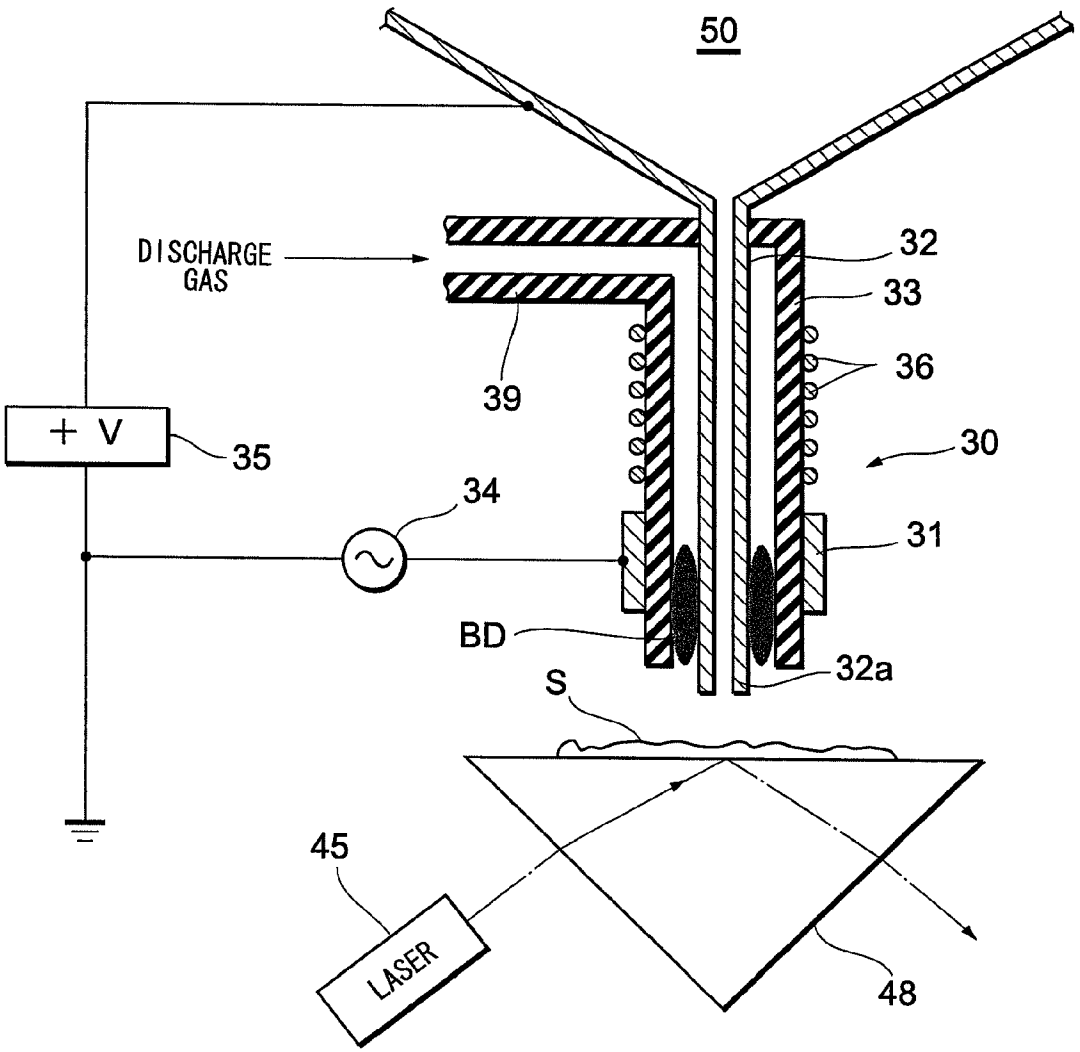
FIG. 26 illustrates a further modification of the ionization apparatus and ionization analysis apparatus according to the third embodiment.

FIG. 26 illustrates another example of promoting desorption by laser light in the positive-ion measurement mode in the same way. A sample is applied to or placed on one face of a prism 48. Laser light from another face of the prism 48 passes through the interior of the prism 48 toward the sample on the above-mentioned face and irradiates the sample. As a result, desorption of the sample is promoted by evanescent waves (near-field light). The desorbed atoms or molecules of the sample are ionized by metastable excited species or ion species, etc., in the thermal equilibrium plasma P. Nano-imaging is possible in this modification as well.

Figure 27:
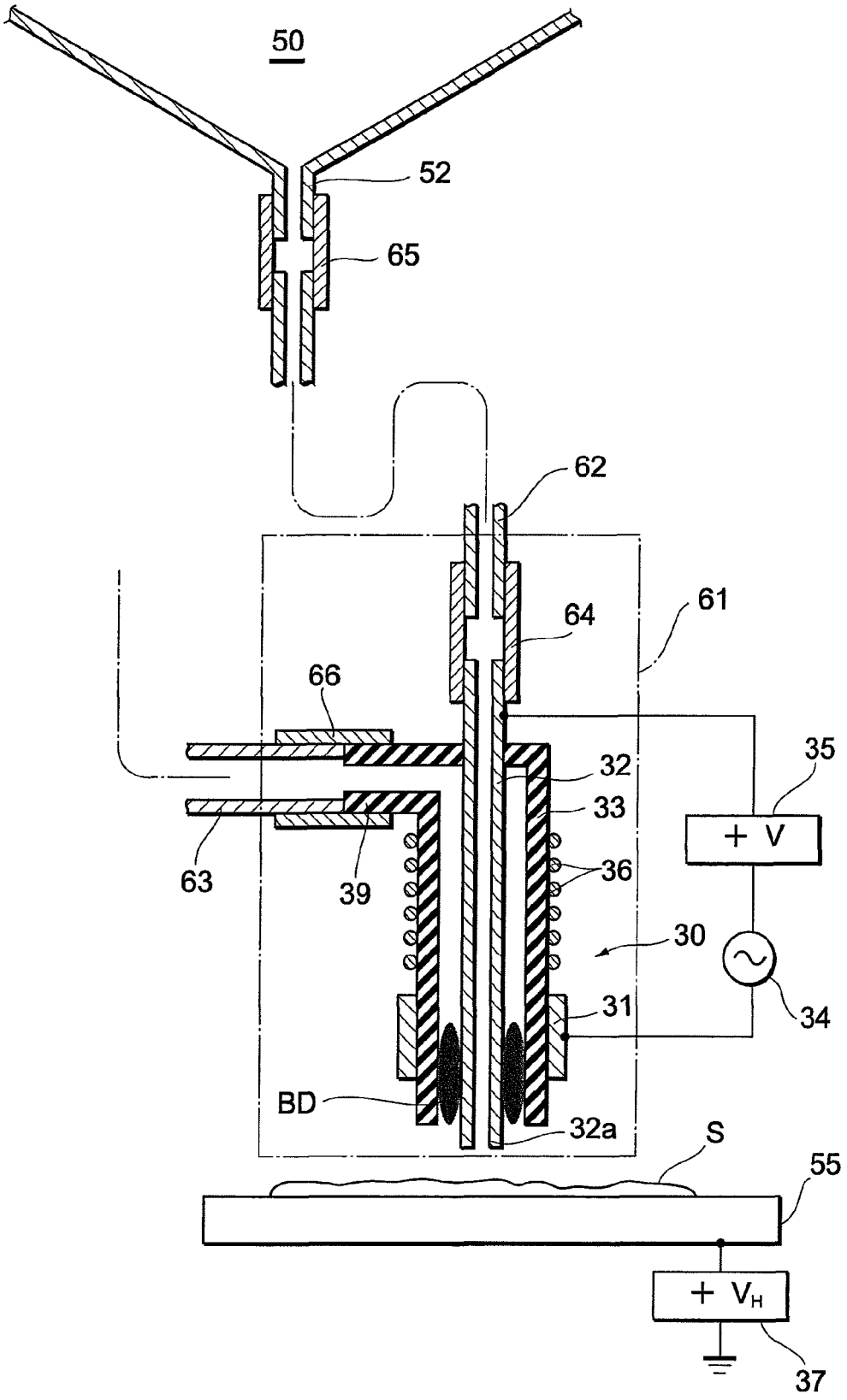
FIG. 27 illustrates a further modification of the ionization apparatus and ionization analysis apparatus according to the third embodiment.

FIG. 27 illustrates a further modification.

This illustrates an arrangement in which the ionization apparatus 30 has been separated from the mass analyzer 50. The cylindrical body 33, first electrode 31 and second electrode (capillary) 32 that constitute the ionization apparatus 30 construct a head 61. As illustrated by way of example in FIG. 28, the head 61 is accommodated as a single unit within a housing (case) (the housing is also indicated by the reference symbol 61 in FIG. 28). The capillary 32 is connected to the ion sampling capillary 52 of mass analyzer 50 by a flexible tube 62 and couplings 64, 65. The gas supply tube 39 also is connected to a gas supply device (not shown) by a flexible tube 63 and coupling 66 in the same manner.

Figure 28:
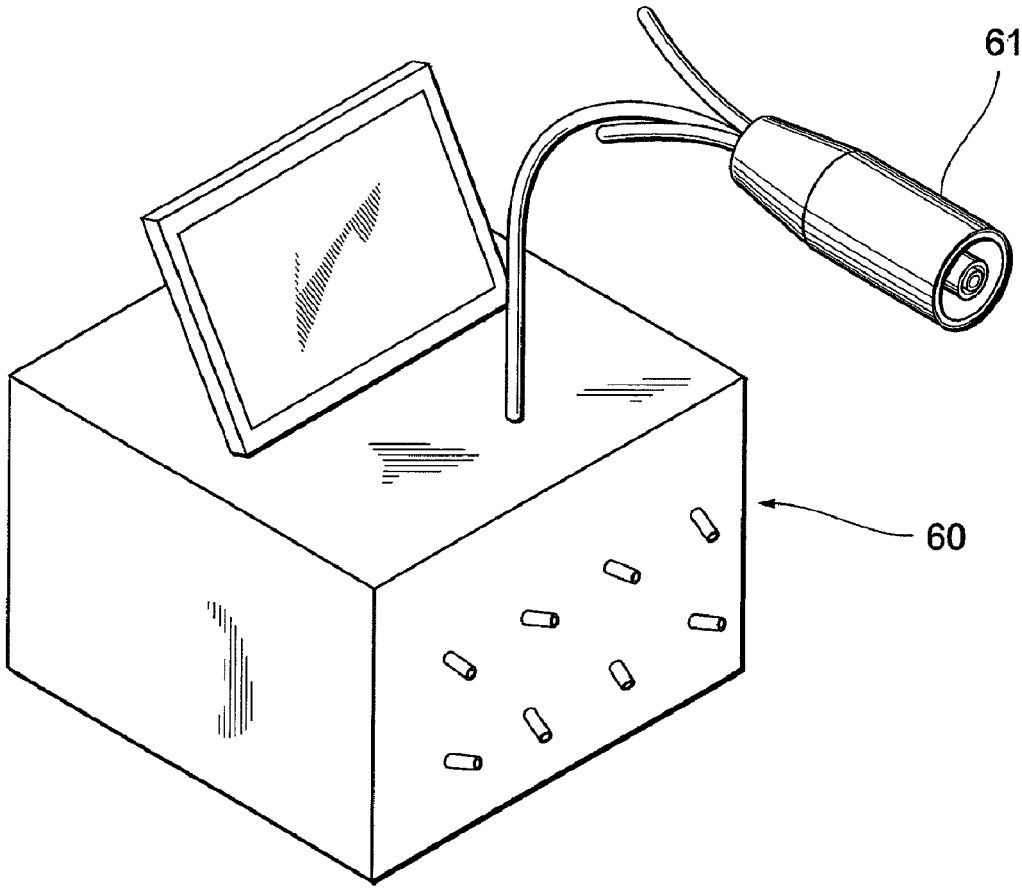
FIG. 28 illustrates an example of the main body and head of a portable analysis apparatus.

The power supply devices 34, 35, mass analyzer 50 and discharge-gas supply device are accommodated within the main body of a portable apparatus 60 shown in FIG. 28.

Figure 29A:
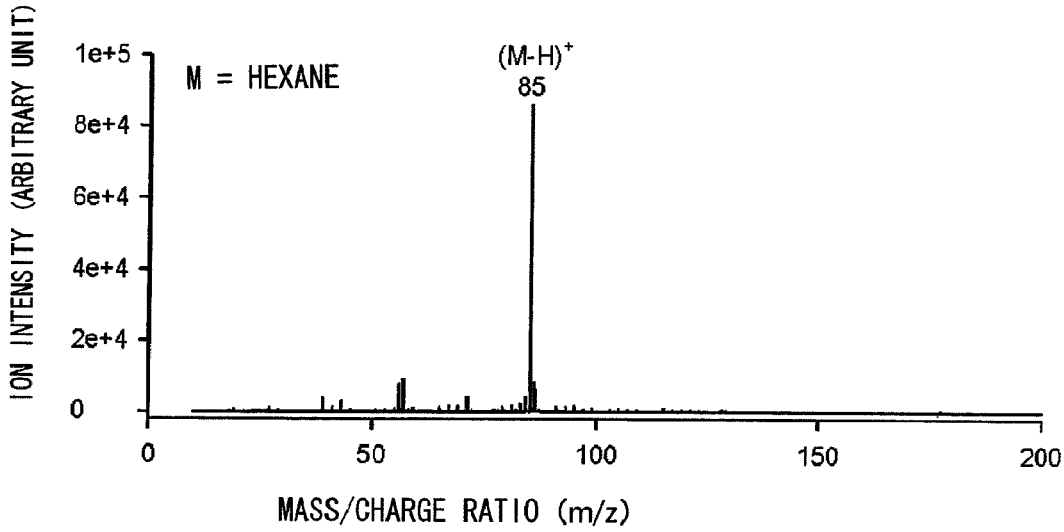
FIG. 29A is a graph illustrating result of analyzing hexane as an example of a nonpolar compound, and FIG. 29B likewise is a graph illustrating result of analyzing cyclohexane.
Figure 29B:
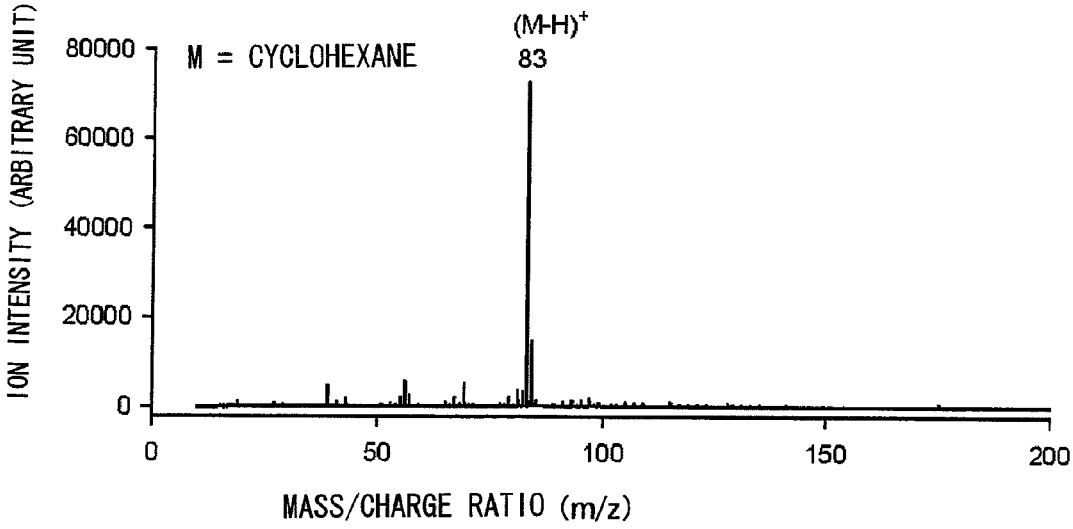

FIGS. 29A and 29B illustrate results of analysis obtained by measurement using the head shown in FIG. 27. FIG. 29A is a graph indicating the result of analyzing hexane, and FIG. 29B is a graph indicating the result of analyzing cyclohexane. Although it is generally difficult to ionize a nonpolar compound, it will be understood that ionization can be achieved with ease using the ionization apparatus of the third embodiment.

Figure 30:
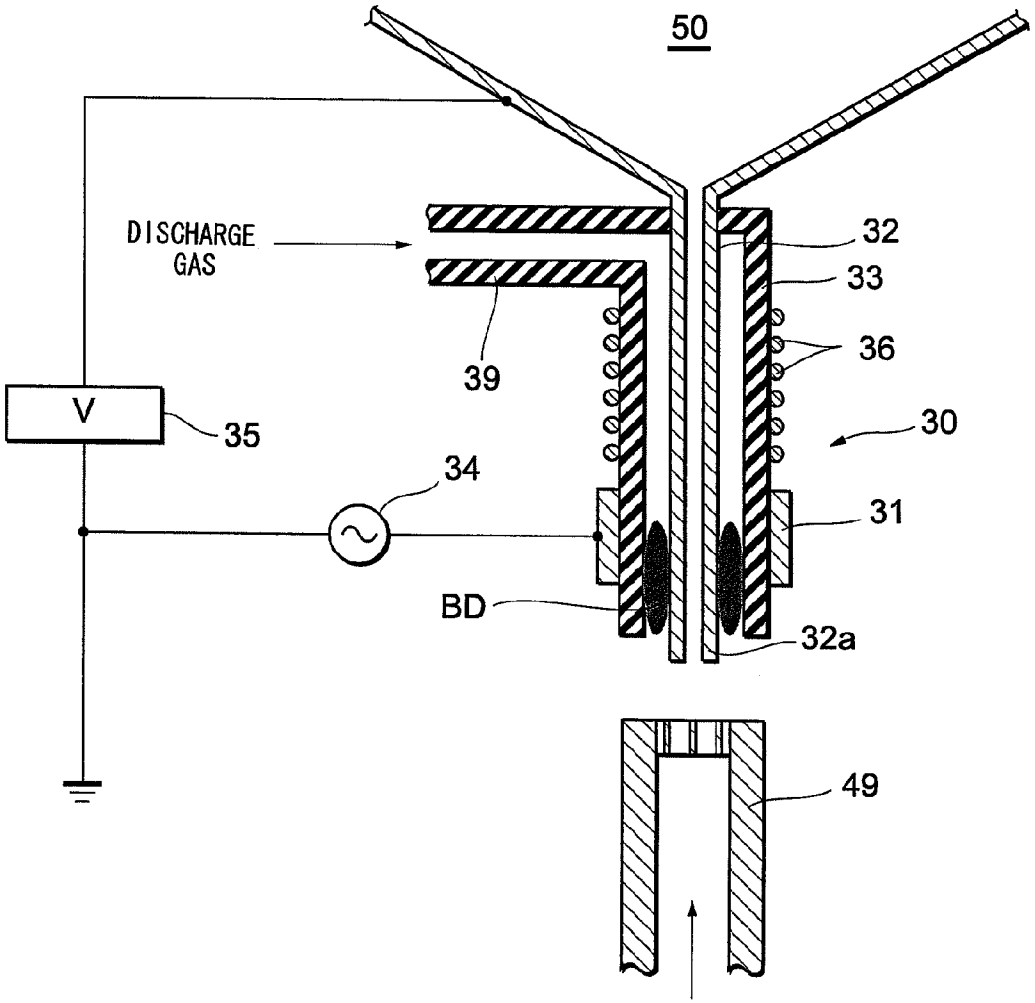
FIG. 30 illustrates a further modification of the ionization apparatus and ionization analysis apparatus according to the third embodiment.

FIG. 30 shows an arrangement suited to the collection and analysis of exhalations, atmospheric air and other gases and illustrates an example in which a desired gas is introduced up to the distal end portion of the cylindrical body 33 of ionization apparatus 30 using a gas suction tube 49.

Although the cross sections of the cylindrical bodies 13, 23, 33 are circular in the foregoing embodiments, it goes without saying that it is possible to use cylindrical bodies of any other shape, such as rectangular (inclusive of square), polygonal (an n-sided polygon, where n is equal to or greater then 3), elliptical or circular. The needle-shaped electrode 12 and capillaries 22, 32 (inner cylindrical body 22) also may have any cross section. Since it will suffice to produce a barrier discharge within the cylindrical body by applying an AC voltage across the first and second electrodes, the first electrode need not necessarily extend over the entire periphery of the outer surface of the cylindrical body and it may be provided at one location or dispersed at two or more locations at a portion of the entire periphery. Likewise, the cylindrical body need not be closed over its entire periphery and may have a cut-out at a portion thereof so that its interior and exterior are in communication. In a case where the vapor pressure of the sample is high, desorption is facilitated. Means for promoting desorption (laser irradiation, heating, spraying of solvent, ultrasonic vibration, near-field light, etc.), therefore, need not necessarily provided. Further, since a barrier discharge is induced even if air is adopted as the discharge gas in the atmosphere, there are also cases where a discharge gas need not necessarily be supplied in positive fashion.

The invention claimed is:

1. An ionization apparatus comprising:

a first cylindrical body comprising a dielectric;

a first electrode provided on the outer side of said first cylindrical body in the vicinity of a distal end portion thereof; and a second electrode disposed inside said first cylindrical body in the vicinity of the center thereof defining a clearance between itself and an inner surface of said first cylindrical body, extending along the longitudinal direction of said first cylindrical body, projecting outwardly from the distal end of said first cylindrical body and passing a position at which said first electrode is provided;

wherein said second electrode is a second cylindrical body for supplying a sample gas or for introducing generated ions and has a distal end that is open.

2. An ionization apparatus according to claim 1, wherein said second electrode is a slender tube made of metal.

3. An ionization apparatus according to claim 1, wherein said second electrode is a capillary for supplying a sample gas, the sample gas being supplied from a rear end thereof.

4. An ionization apparatus according to claim 1, wherein said second electrode is a capillary for introducing ions, the capillary communicating with the interior of a mass analyzer.

5. An ionization apparatus according to claim 1, wherein said second electrode is formed as a metal portion on the surface of an inner cylindrical body, which exhibits an insulating property, at least from the position of said first electrode to the distal end.

6. An ionization apparatus according to claim 1, further comprising a mesh electrode disposed outwardly of a distal end of said second electrode in close proximity to this distal end.

7. An ionization analysis apparatus comprising the ionization apparatus, which is set forth in claim 1, and a mass analyzer.

8. An ionization method using the ionization apparatus set forth in claim 1 comprising:

impressing an AC voltage across said first and second electrodes; and exposing a sample to a charged gas stream generated from the distal end of said first cylindrical body.

9. An ionization method according to claim 8, further comprising impressing a DC voltage across said first and second electrodes and generating a positive-ion rich or negative-ion rich charge gas current in accordance with polarity of this DC voltage.

10. An ionization method according to claim 9, further comprising applying a voltage having a polarity the same as that of said DC voltage and an absolute value larger than that of said DC voltage to a conductor placed rearwardly of the sample.

11. An ionization method according to claim 8, further comprising applying a positive or negative DC voltage to a mesh electrode disposed outwardly of the distal end of said second electrode in close proximity to this distal end.

12. An ionization method according to claim 8, further comprising supplying a discharge gas or carrier gas to a gap in said first cylindrical body between said first cylindrical body and said second electrode.

13. An ionization method according to claim 12, further comprising promoting desorption of the sample by heating said discharge gas or carrier gas.

14. An ionization method according to claim 8, further comprising spraying fine droplets of a solvent onto the sample and promoting desorption of the sample.

15. An ionization method according to claim 8, further comprising promoting desorption of the sample by heating the sample.

16. An ionization method according to claim 8, further comprising promoting desorption of the sample by subjecting the sample to ultrasonic vibration.

17. An ionization method according to claim 8, further comprising promoting desorption of the sample by irradiating the sample with laser light.

18. An ionization method according to claim 8, further comprising promoting desorption of the sample by forming a photon field in the vicinity of the sample surface.

19. An ionization analysis method comprising introducing sample ions, which have been produced by the ionization method set forth in claim 8, to an analyzing apparatus.

* * * * *